US010504330B2

(12) United States Patent
Lamb

(10) Patent No.: US 10,504,330 B2
(45) Date of Patent: Dec. 10, 2019

(54) GAMING APPARATUSES AND METHODS FOR ENHANCING PAYOUTS WITH AUXILIARY WAGERS

(71) Applicant: KING SHOW GAMES, INC., Minnetonka, MN (US)

(72) Inventor: Jacob Lamb, Maple Grove, MN (US)

( * ) Notice: Subject to any disclaimer, the term of this patent is extended or adjusted under 35 U.S.C. 154(b) by 217 days.

(21) Appl. No.: 15/801,578

(22) Filed: Nov. 2, 2017

(65) Prior Publication Data

US 2018/0130307 A1 May 10, 2018

Related U.S. Application Data

(60) Provisional application No. 62/419,413, filed on Nov. 8, 2016.

(51) Int. Cl.

| | |
|---|---|
| ***G07F 17/32*** | (2006.01) |
| ***G07F 17/00*** | (2006.01) |
| ***G07F 19/00*** | (2006.01) |

(52) U.S. Cl.

CPC ..... *G07F 17/3267* (2013.01); *G07F 17/3213* (2013.01); *G07F 17/3244* (2013.01); *G07F 17/3265* (2013.01)

(58) Field of Classification Search

CPC .. G07F 17/32; G07F 17/3204; G07F 17/3211; G07F 17/3213; G07F 17/3244; G07F 17/3258; G07F 17/326; G07F 17/3262; G07F 17/3265; G07F 17/3267; G07F 17/3293; G07F 17/3295; G07F 17/34; G06Q 50/34

See application file for complete search history.

(56) References Cited

U.S. PATENT DOCUMENTS

| | | | | |
|---|---|---|---|---|
| 5,704,835 | A * | 1/1998 | Dietz, II | G07F 17/3265 273/143 R |
| 7,377,850 | B2 * | 5/2008 | Shackelford | G07F 17/3244 463/20 |
| 8,333,650 | B2 * | 12/2012 | Vann | G07F 17/34 463/20 |
| 8,602,873 | B2 * | 12/2013 | Barton | G07F 17/32 463/20 |
| 9,218,705 | B2 * | 12/2015 | Taylor | G07F 17/3265 |
| 9,934,651 | B2 * | 4/2018 | Watkins | G07F 17/3258 |
| 2002/0068623 | A1 * | 6/2002 | Gauselmann | G07F 17/3265 463/20 |
| 2004/0219969 | A1 * | 11/2004 | Casey | G07F 17/3211 463/20 |
| 2005/0192080 | A1 * | 9/2005 | Cote | G07F 17/3265 463/17 |

(Continued)

*Primary Examiner* — Milap Shah

(57) ABSTRACT

Systems, apparatuses and methods for facilitating gaming payout enhancements through player purchase of a desired number of options to qualify to receive a commensurate quantity of a randomly-generated number of payout award enhancements. A player can purchase some number of payout enhancement options for a gaming event. A number of payout enhancement awards may be randomly granted. A number of the symbol upgrade awards that does not exceed the number of symbol upgrade options purchased are activated for use, and the initial gaming event results are updated with the activated number of the symbol upgrade awards. The gaming event, as modified, is then analyzed for payout results using any symbol upgrades.

17 Claims, 14 Drawing Sheets

(56) References Cited

U.S. PATENT DOCUMENTS

2006/0068892 A1* 3/2006 Gomez ..... G07F 17/3244 463/20
2007/0015565 A1* 1/2007 Chan ..... G07F 17/3211 463/20
2007/0077976 A1* 4/2007 Jackson ..... G07F 17/3265 463/13
2008/0242404 A1* 10/2008 Aoki ..... G07F 17/3244 463/26
2008/0287178 A1* 11/2008 Berman ..... G07F 17/3211 463/20
2009/0117989 A1* 5/2009 Arezina ..... G07F 17/32 463/20
2009/0170588 A1* 7/2009 Baerlocher ..... G07F 17/3244 463/20
2009/0305769 A1* 12/2009 Plowman ..... G07F 17/32 463/20
2012/0172106 A1* 7/2012 Caputo ..... G07F 17/3244 463/20
2013/0035154 A1* 2/2013 Watkins ..... G07F 17/326 463/21
2013/0344939 A1* 12/2013 Aoki ..... G07F 17/326 463/21
2014/0100009 A1 4/2014 Tsai et al.
2014/0179396 A1* 6/2014 Aoki ..... G07F 17/3267 463/20
2015/0065224 A1* 3/2015 Aoki ..... G07F 17/34 463/20
2015/0080092 A1* 3/2015 Caputo ..... G07F 17/326 463/20
2015/0087385 A1* 3/2015 Shiraishi ..... G07F 17/34 463/20
2015/0283454 A1 10/2015 Wei
2015/0356813 A1* 12/2015 Mead ..... G07F 17/34 463/20
2016/0379439 A1* 12/2016 Galasso ..... G07F 17/3227 463/21

* cited by examiner

GAMING APPARATUSES AND METHODS FOR ENHANCING PAYOUTS WITH AUXILIARY WAGERS

FIELD

This disclosure relates generally to games, and more particularly to gaming systems, apparatuses and methods for facilitating gaming payout enhancements through auxiliary player wagers.

BACKGROUND

Casino games such as poker, slots, and craps have long been enjoyed as a means of entertainment. Some of these games originated using traditional elements such as playing cards or dice. More recently, gaming devices have been developed to simulate and/or further enhance these games while remaining entertaining. The popularity of casino gambling with wagering continues to increase, as does recreational gambling such as non-wagering computer game gambling. Part of this popularity is due to the increased development of new types of games that are implemented, at least in part, on gaming devices.

One reason that casino games are widely developed for gaming devices is that a wide variety of games can be implemented on gaming devices, thereby providing an array of choices for players looking to gamble. For example, the graphics and sounds included in such games can be modified to reflect popular subjects, such as movies and television shows. Game play rules and types of games can also vary greatly providing many different styles of gambling. Additionally, gaming devices require minimal supervision to operate on a casino floor, or in other gambling environments. That is, as compared to traditional casino games that require a dealer, banker, stickman, pit managers, etc., gaming devices need much less employee attention to operate.

With the ability to provide new content, players have come to expect the availability of an ever wider selection of new games when visiting casinos and other gaming venues. Playing new games adds to the excitement of "gaming." As is well known in the art and as used herein, the term "gaming" and "gaming devices" generally involves some form of wagering, and that players make wagers of value, whether actual currency or something else of value, e.g., token or credit. Wagering-type games usually provide rewards based on random chance as opposed to skill, although some skill may be an element in some types of games. Since random chance is a significant component of these games, they are sometimes referred to as "games of chance."

The present disclosure describes systems, apparatuses and methods that facilitate new and interesting gaming experiences, and provide advantages over the prior art.

SUMMARY

The present disclosure is directed to systems, apparatuses, computer-readable media, and/or methods that are configured to facilitate gaming payout enhancements through player purchase of a desired number of options to qualify to receive a commensurate quantity of a randomly-generated number of payout award enhancements.

In one embodiment, a slot game apparatus is provided for enhancing gaming awards in a slot game utilizing symbols in respective symbol positions of a symbol grid to determine payouts. The slot game apparatus includes a display, a user interface, a wager input device, and a processor. The display presents a plurality of symbol locations forming a symbol array. The user interface includes a user input to enable a player to initiate a slot game event presented via the symbol array. The wager input device is structured to identify and validate player assets, and to permit the player to play the slot game event when the player assets are provided. The processor is configured to facilitate player purchase of zero, one, or a plurality of symbol upgrade options, present an initial spin result, randomly awarding zero, one, or a plurality of symbol upgrade awards, activate a number of the randomly awarded symbol upgrade awards that does not exceed the number of symbol upgrade options purchased, replace symbols of the initial spin result with the activated number of the randomly awarded symbol upgrade awards, and analyze a final result for payouts using the initial spin result as modified by the replaced symbols.

In a more particular embodiment, the processor is configured to randomly award zero, one, or a plurality of symbol upgrade awards by randomly awarding at least one of the symbol upgrade awards, and randomly positioning the randomly awarded the at least one of the symbol upgrade awards in respective ones of the symbol positions to replace the symbols therein with the respective symbol upgrade awards.

In another embodiment, the processor is further configured to recognize player purchase of zero of the symbol upgrade options, where the processor is configured to activate a number of the randomly awarded symbol upgrade awards that does not exceed the number of symbol upgrade options purchased comprises activating zero of the randomly awarded symbol upgrade awards.

In another embodiment of the slot game apparatus, the processor is configured to recognize player purchase of a number of the symbol upgrade options, where the processor is configured to activate a number of the randomly awarded symbol upgrade awards that does not exceed the number of symbol upgrade options purchased comprises activating fewer of the randomly awarded symbol upgrade awards than were randomly awarded in response to the player's purchase of fewer of the symbol upgrade options than the number of the symbol upgrade awards that were randomly awarded.

In yet another embodiment of such a slot game apparatus, the processor is further configured to recognize player purchase of a number of the symbol upgrade options, where the processor is configured to activate a number of the randomly awarded symbol upgrade awards that does not exceed the number of symbol upgrade options purchased comprises activating fewer of the randomly awarded symbol upgrade awards than the number of symbol upgrade options that were purchased, in response to a the player's purchase of more of the symbol upgrade options than the number of the symbol upgrade awards that were randomly awarded.

Other embodiments involve the processor being configured to replace symbols of the initial spin result by replacing the symbols of the initial spin result with symbols having a higher game value than the symbols of the initial spin result. In one embodiment, replacing the symbols of the initial spin result comprises replacing the symbols of the initial spin result with wild symbols, where in another embodiment, replacing the symbols of the initial spin result with wild symbols further comprises associating a payout multiplier value with each of the wild symbols.

In another embodiment of such a slot game apparatus, the processor is further configured to provide a visual transition from the symbol upgrade awards to activated ones of the symbol upgrade awards.

In another embodiment, a game apparatus is provided for enhancing gaming awards in a slot game utilizing symbols in respective symbol positions of a symbol grid to determine payouts. The game apparatus includes a display, a user interface, a wager input device, and a processor. The display presents a plurality of symbol locations forming a symbol array. The user interface includes a user input to enable a player to initiate a slot game event presented via the symbol array. The wager input device is structured to identify and validate player assets, and to permit the player to play the slot game event when the player assets are provided. The processor is configured to facilitate purchase by a player of a first number of payout enhancement options, present an initial result of a gaming event, and randomly provide a second number of payout enhancement awards, each capable of upgrading a respective symbol of the initial result of the gaming event. If the processor determines that the first number of payout enhancement options purchased by the player is not zero and is greater than or equal to the second number of randomly provided payout enhancement awards, the processor is configured to activate all of the second number of payout enhancement awards. If the processor determines that the first number of payout enhancement options purchased by the player is less than the second number of randomly provided payout enhancement awards, the processor is configured to activate the first number of the payout enhancement awards. A final result of the gaming event is presented, using the activated payout enhancement awards.

In one embodiment of such a game apparatus, the first number of payout enhancement options purchased by the player is zero, and none of the second number of provided payout enhancement awards are activated.

In another embodiment of such a game apparatus, the processor is configured to activate the first number of the payout enhancement awards by randomly selecting symbols of the gaming event to upgrade to upgraded symbols, and activating the first number of the payout enhancement awards to replace the randomly selected symbols.

In still another embodiment, the processor is configured to activate the first number of the payout enhancement awards by randomly selecting symbol locations of the gaming event to upgrade their respective initial symbols to upgraded symbols, and activating the first number of the payout enhancement awards to replace the initial symbols at the randomly selected symbol locations.

Yet another embodiment involves the processor being configured to randomly provide the second number of payout enhancement awards further by revealing to the player the payout enhancement awards that were not activated as a result of the player failing to purchase enough of the payout enhancement options to activate the payout enhancement awards that were not activated.

In one embodiment, the first number of payout enhancement opportunities is between zero and three, where in yet another embodiment the second number of payout enhancement awards is between zero and three.

This summary serves as an abbreviated, selective introduction of a representative subset of various concepts and embodiments that are further described or taught to those skilled in the art in the Specification herein. This summary is not intended to refer to all embodiments, scopes, or breadths of claims otherwise supported by the Specification, nor to identify essential features of the claimed subject matter, nor to limit the scope of the claimed subject matter.

DETAILED DESCRIPTION

Figure 1:
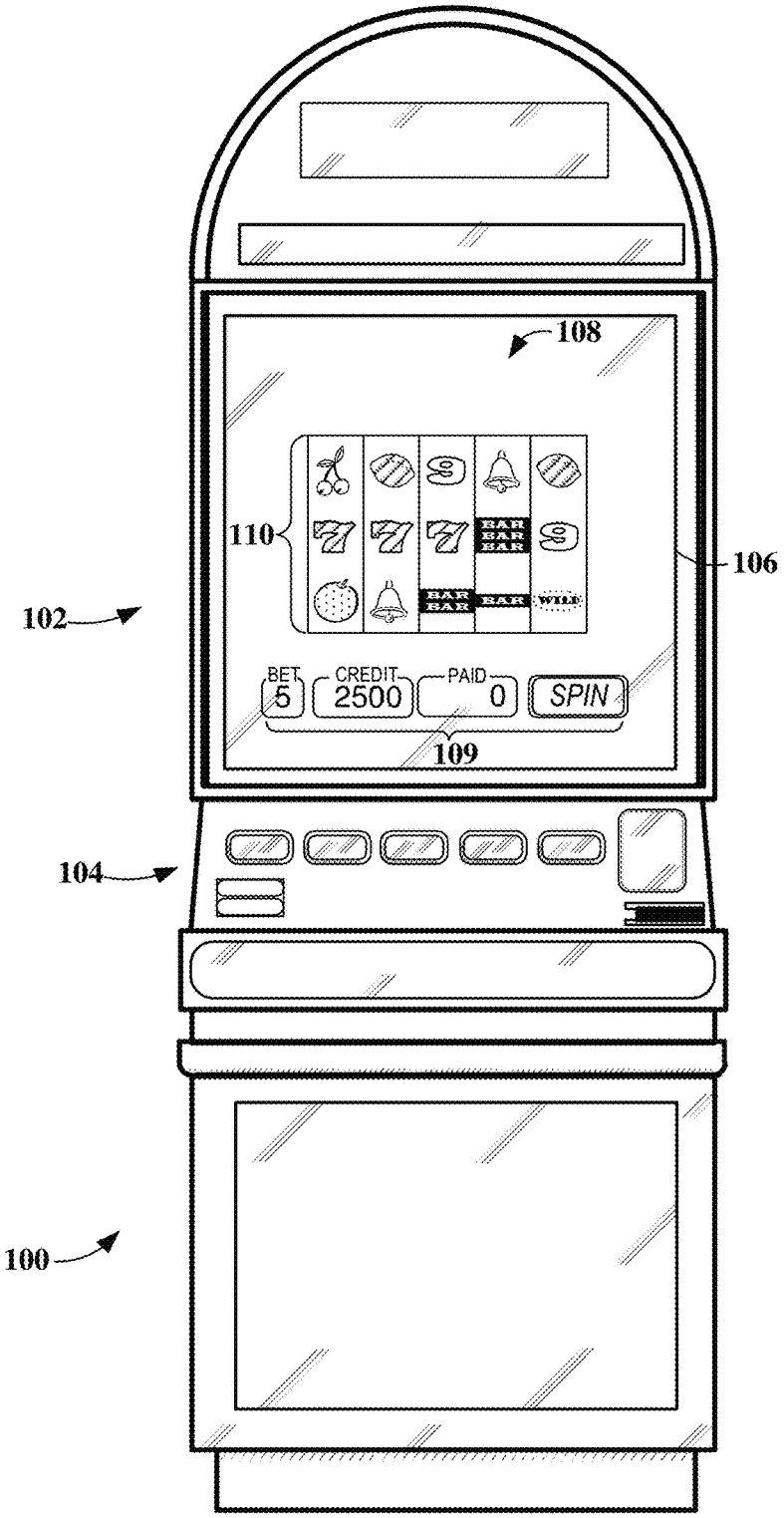
FIG. 1 is a diagram of a representative gaming machine capable of facilitating player use and interaction with games and features in accordance with the invention and representative embodiments described herein.

In the following description of various exemplary embodiments, reference is made to the accompanying drawings which form a part hereof, and in which is shown by way of illustration representative embodiments in which the features described herein may be practiced. It is to be understood that other embodiments may be utilized, as structural and operational changes may be made without departing from the scope of the disclosure.

In the description that follows, the terms "reels," "cards," "decks," and similar mechanically descriptive language may be used to describe various apparatus presentation features, as well as various actions occurring to those objects (e.g., "spin," "draw," "hold," "bet"). Although the present disclosure may be applicable to manual, mechanical, and/or computerized embodiments, as well as any combination therebetween, the use of mechanically descriptive terms is not meant to be only applicable to mechanical embodiments. Those skilled in the art will understand that, for purposes of providing gaming experiences to players, mechanical elements such as cards, reels, and the like may be simulated on a display in order to provide a familiar and satisfying experience that emulates the behavior of mechanical objects, as well as emulating actions that occur in the non-computerized games (e.g., spinning, holding, drawing, betting). Further, the computerized version may provide the look of mechanical equivalents but may be generally randomized in a different way. Thus, the terms "cards," "decks," "reels," "hands," etc., are intended to describe both physical objects and emulation or simulations of those objects and their behaviors using electronic apparatuses.

In various embodiments, the gaming displays are described in conjunction with the use of data in the form of "symbols." In the context of this disclosure, a "symbol" may generally refer at least to a collection of one or more arbitrary indicia or signs that have some conventional or defined significance. In particular, the symbol may represent values that can at least be used to determine whether to award a payout. A symbol may include numbers, letters, shapes, pictures, textures, colors, sounds, etc., and any combination therebetween. A play state, such as a win, can be determined by comparing the symbol with one or more other symbols. Such comparisons can be performed, for example, via software by mapping numbers (or other data structures such as character strings) to the symbols and performing the comparisons on the numbers/data structures. Other conventions associated with known games (e.g., the numerical value/ordering of face cards and aces in card games) may also be programmatically analyzed to determine winning combinations.

Generally, systems, apparatuses and methods are described for facilitating gaming payout enhancements through player purchase of a desired number of options to qualify to receive a commensurate quantity of a randomly-generated number of payout award enhancements. For example, one embodiment of such systems, apparatuses and methods involves implementing random multipliers on game grids of gaming devices in response to receiving a side wager. The systems, apparatuses and methods described herein may be implemented as a single game, or part of a multi-part game. For example, the game features described herein may be implemented in primary gaming activities, bonus games, side bet games or other secondary games associated with a primary gaming activity. The game features may be implemented in stand-alone games, multi-player games, etc. Further, the disclosure may be applied to games of chance, and descriptions provided in the context of any representative game (e.g. slot game) is provided for purposes of facilitating an understanding of the features described herein. However, the principles described herein are equally applicable to any game of chance where an outcome(s) is determined for use in the player's gaming activity.

Embodiments of the present concept include providing gaming devices (also referred to as gaming apparatuses or gaming machines), gaming systems, and methods of operating these devices or systems to provide game play that involves allowing a player to purchase symbol upgrade options to qualify to receive a commensurate quantity of a randomly-generated number of payout award enhancements. This may involve implementing random multipliers on game grids of gaming devices in response to receiving a side wager. In one embodiment, a method of operating a gaming device includes providing a player the option of placing a side bet or wager to activate one or more random multipliers on the game grid.

Numerous variations are possible in view of these and other embodiments of the inventive concept. Representative embodiments and variations are described herein, with some embodiments described with reference to the drawings. However, many other embodiments and variations exist that are covered by the principles and scope of this concept. For example, although some of the embodiments discussed below involve reel-based slot machine examples of this concept, other embodiments include application of these inventive techniques in other types of slot games, poker games, roulette, bingo, or other games of chance. Some of these other types of embodiments will be discussed below as variations to the examples illustrated. However, many other types of games can implement similar techniques and fall within the scope of this disclosed concept.

Referring to the example gaming apparatus 100 shown in FIG. 1, the representative gaming apparatus includes at least a display area(s) 102 (also referred to as a gaming display), and a player interface area(s) 104, although some or all of the interactive mechanisms included in the user interface area 104 may be provided via other or additional means, such as graphical icons used with a touch screen in the display area 102 in some embodiments. The display area 102 may include one or more game displays 106 (also referred to as "displays" or "gaming displays") that may be included in physically separate displays or as portions of a common large display. Here, the representative game display 106 includes at least a primary game play portion 108 that displays game elements and symbols 110, and an operations portion 109 that can include meters, various game buttons and other input mechanisms, and/or other game information for a player of the gaming device 100.

The user interface 104 allows the user to control, engage in play of, and otherwise interact with the gaming machine 100. The particular user interface mechanisms included with user interface 104 may be dependent on the type of gaming device. For example, the user interface 104 may include one or more buttons, switches, joysticks, levers, pull-down handles, trackballs, voice-activated input, touchscreen input, tactile input, and/or any other user input system or mechanism that allows the user to play and interact with the particular gaming activity.

The user interface 104 may allow the user or player to enter coins, bills, or otherwise obtain credits through vouchers, tokens, credit cards, tickets, electronic money, etc. Various mechanisms for entering such vouchers, tokens, credit cards, coins, tickets, etc. are described below with reference to FIG. 2. For example, currency input mechanisms, card readers, credit card readers, smart card readers, punch card readers, radio frequency identifier (RFID) readers, and other mechanisms may be used to enter wagers. The user interface 104 may also include a mechanism to read and/or validate player information, such as player loyalty information to identify a user or player of the gaming device. This mechanism may be, for example, a card reader, biometric scanner, keypad, or other input device. It is through a user interface such as the user interface 104 that the player can initiate and engage in gaming activities. While the illustrated embodiment depicts various buttons for the user interface 104, it should be recognized that a wide variety of user interface options are available for use in connection with the present invention, including pressing buttons, touching a segment of a touch-screen, entering text, entering voice commands, or other known data entry methodology.

The game display 106 in the display area 102 may include one or more of an electronic display, a video display, a mechanical display, and fixed display information, such as pay table information associated with a glass/plastic panel(s) on the gaming machine 100 and/or graphical images. The symbols or other indicia associated with the play of the game may be presented on an electronic display device or on mechanical devices associated with a mechanical display. Generally, in some embodiments, the display 106 devotes the largest portion of viewable area to the primary gaming portion 108. The primary gaming portion 108 may provide visual feedback to the user for any selected game. The primary gaming portion 108 may render graphical objects such as cards, slot reels, dice, animated characters, and any other gaming visual known in the art. The primary gaming portion 108 may also inform players of the outcome of any particular event, including whether the event resulted in a win or loss.

In some example embodiments illustrated herein, the primary gaming portion 108 may display a grid (or equivalent arrangement) of game elements 110 or game element positions (also referred to herein as "reel stop positions"). As illustrated in the embodiment shown in FIG. 1, the grid includes three rows and five columns of game elements 110, which may form a game outcome(s) of a game play event from which prizes are determined. In some slot machine examples, each column may display a portion of a game reel. The game reels may include a combination of game symbols in a predefined order. In mechanical examples, the game reels may include physical reel strips where game symbols are shown in images fixed on the reel strips. Virtual reel strips may be mapped to these physical reel positions shown on the reel strips to expand the range or diversity of game outcomes. In video slot examples, reel strips may be encoded in a memory or database and virtual reels may be used for the game reels with images representing the data related to the reel strips. In other slot machine embodiments, each reel stop position on the grid may be associated with an independent reel strip. In yet other slot machine embodiments, reels and/or reel strips may not be used at all in determining the symbols shown in the game element positions of the grid. For example, a symbol may be randomly selected for each game element position, or the symbols may be determined in part by game events occurring during game play, such as displayed elements being replaced by new game elements or symbols. Numerous variations are possible for implementing slot-type game play.

The primary gaming portion 108 may include other features known in the art that facilitate gaming, such as status and control portion 109. As is generally known in the art, this portion 109 provides information about current bets, current wins, remaining credits, etc. associated with gaming activities of the grid of game elements 110. The control portion 109 may also provide touchscreen controls for facilitating game play. The grid of game elements 110 may also include touchscreen features, such as facilitating selection of individual symbols, or user controls over stopping or spinning reels. The game display 106 of the display area 102 may include other features that are not shown, such as pay tables, navigation controls, etc.

Figure 2:
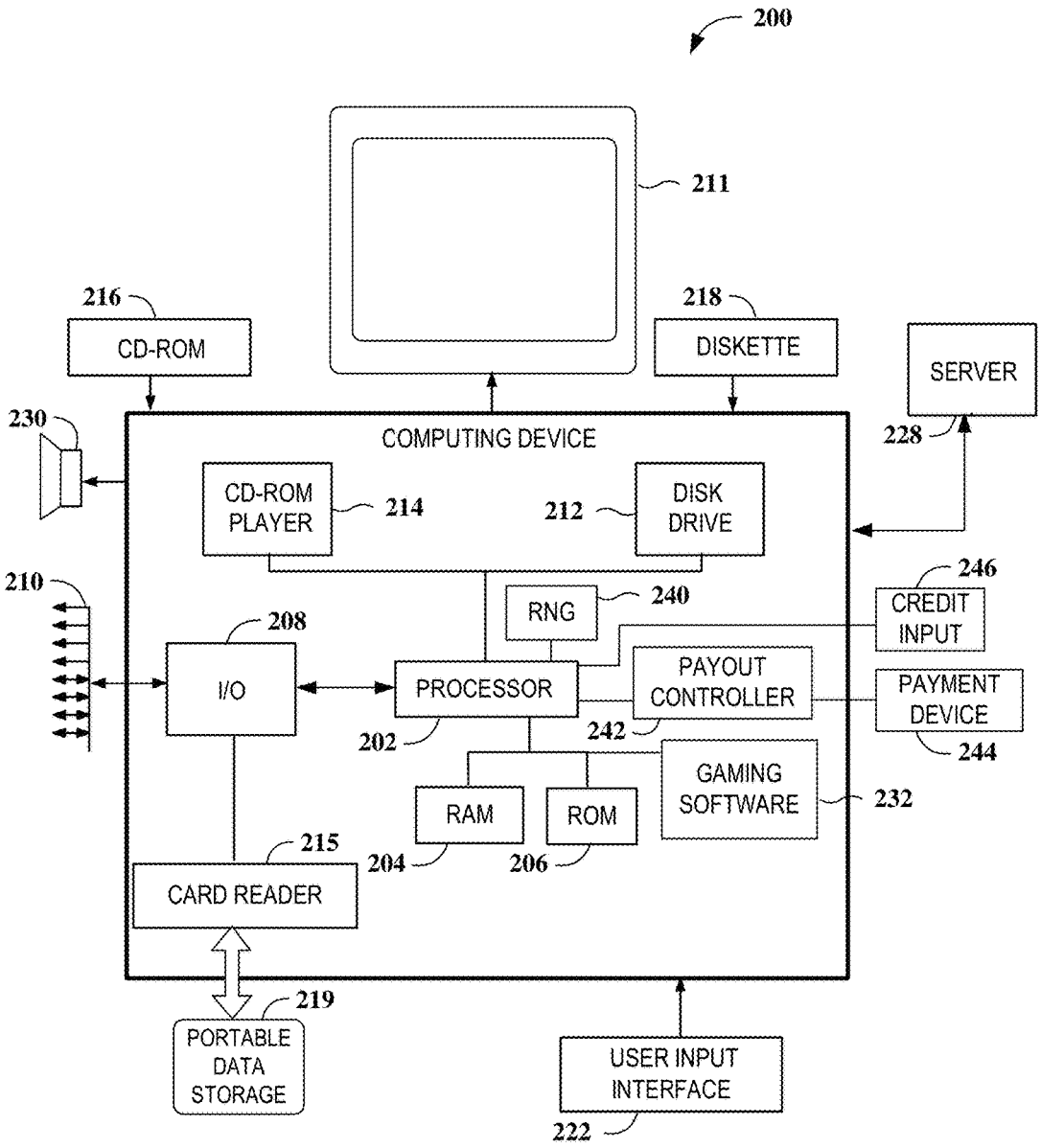
FIG. 2 is a block diagram illustrating a representative computing arrangement capable of implementing games and features in accordance with the invention and representative embodiments described herein.

Although FIG. 1 illustrates a particular implementation of some of the embodiments of this invention in a casino or electronic gaming machine ("EGM"), one or more devices may be programmed to play various embodiments of the invention. The concepts and embodiments described herein may be implemented, as shown in FIG. 1, as a casino gaming machine or other special purpose gaming kiosk as described herein, or may be implemented via computing systems operating under the direction of local gaming software, and/or remotely-provided software such as provided by an application service provider (ASP). Casino gaming machines may also utilize computing systems to control and manage the gaming activity, although these computing systems typically include specialized components and/or functionality to operate the particular elements of casino gaming machines. Additionally, computing systems operating over networks, such as the Internet, may also include specialized components and/or functionality to operate elements particular to these systems, such as random number generators. An example of a representative computing system capable of carrying out operations in accordance with the principles described herein is illustrated in FIG. 2.

Hardware, firmware, software or any combination thereof may be used to perform the various gaming functions, display presentations and operations described herein. The functional modules used in connection with the disclosure may reside in a gaming machine as described, or may alternatively reside on a stand-alone or networked computer. The representative computing structure 200 of FIG. 2 is an example of a computing structure that can be used in connection with such electronic gaming machines, computers, or other computer-implemented devices to carry out operations of the present invention. Although numerous components or elements are shown as part of this computing structure 200 in FIG. 2, additional or fewer components may be utilized in particular implementations of embodiments of the invention.

The example computing arrangement 200 suitable for performing the gaming functions described herein includes a processor, such as depicted by the representative central processing unit (CPU) 202, coupled to memory, such as random access memory (RAM) 204, and some variation of read-only memory (ROM) 206 or other persistent storage. The ROM 206 may also represent other types of storage media to store programs, such as programmable ROM (PROM), erasable PROM (EPROM or any technology capable of storing data). The processor 202 may communicate with other internal and external components through input/output (I/O) circuitry 208 and bussing 210, to communicate control signals, communication signals, and the like.

The computing arrangement 200 may also include one or more data storage devices, including hard and floppy disk drives 212, CD-ROM drives 214, card reader 215, and other hardware capable of reading and/or storing information such as DVD, etc. In one embodiment, software for carrying out the operations in accordance with the present invention may be stored and distributed on a CD-ROM 216, diskette 218, access card 219, or other form of computer readable media capable of portably storing information. These storage media may be inserted into, and read by, devices such as the CD-ROM drive 214, the disk drive 212, card reader 215, etc. The software may also be transmitted to the computing arrangement 200 via data signals, such as being downloaded electronically via a network, such as local area network (casino, property, or bank network) or a wide area network (e.g., the Internet). Further, as previously described, the software for carrying out the functions associated with the present invention may alternatively be stored in internal memory/storage of the computing device 200, such as in the ROM 206.

The computing arrangement 200 is coupled to one or more displays 211, which represent a manner in which the gaming activities may be presented. The display 211 represents the "presentation" of the game information in accordance with the disclosure, and may be a mechanical display showing physical spinning reels, a video display, such as liquid crystal displays, plasma displays, cathode ray tubes (CRT), digital light processing (DLP) displays, liquid crystal on silicon (LCOS) displays, etc., or any type of known display or presentation screen.

Where the computing device 200 represents a stand-alone or networked computer, the display 211 may represent a standard computer terminal or display capable of displaying multiple windows, frames, etc. Where the computing device 200 represents a mobile electronic device, the display 211 may represent the video display of the mobile electronic device. Where the computing device 200 is embedded within an electronic gaming machine, the display 211 corresponds to the display screen of the gaming machine/kiosk.

A user input interface 222 such as a mouse, keyboard/keypad, microphone, touch pad, trackball, joystick, touch screen, voice-recognition system, card reader, biometric scanner, RFID detector, etc. may be provided. The user input interface 222 may be used to input commands in the computing arrangement 200, such as placing wagers or initiating gaming events on the computing arrangement 200, inputting currency or other payment information to establish a credit amount or wager amount, inputting data to identify a player for a player loyalty system, etc. The display 211 may also act as a user input device, e.g., where the display 211 is a touchscreen device. In embodiments, where the computing device 200 is implemented in a personal computer, tablet, smart phone, or other consumer electronic device, the user interface and display may be the available input/output mechanisms related to those devices.

Chance-based gaming systems such as slot machines, in which the present invention is applicable, are governed by random numbers and processors, as facilitated by a random number generator (RNG) or other random generator. The fixed and dynamic symbols generated as part of a gaming activity may be produced using one or more RNGs. RNGs may be implemented using hardware, software operable in connection with the processor 202, or some combination of hardware and software. The principles described herein are operable using any known RNG, and may be integrally programmed as part of the processor 202 operation, or alternatively may be a separate RNG controller 240 that may be associated with the computing arrangement 200 or otherwise accessible such as via a network. The RNGs are often protected by one or more security measures to prevent tampering, such as by using secured circuitry, locks on the physical game cabinet, and/or remote circuitry that transmits data to the gaming device.

The computing arrangement 200 may be connected to other computing devices or gaming machines, such as via a network. The computing arrangement 200 may be connected to a network server(s) 228 in an intranet or local network configuration. The computer may further be part of a larger network configuration as in a global area network (GAN) such as the Internet. In such a case, the computer may have access to one or more web servers via the Internet. In other arrangements, the computing arrangement 200 may be configured as an Internet server and software for carrying out the operations in accordance with the present invention may interact with the player via one or more networks. The computing arrangement 200 may also be operable over a social network or other network environment that may or may not regulate the wagering and/or gaming activity associated with gaming events played on the computing arrangement.

Other components directed to gaming machine implementations include manners of gaming participant payment, and gaming machine payout. For example, a gaming machine including the computing arrangement 200 may also include a payout controller 242 to receive a signal from the processor 202 or other processor(s) indicating a payout is to made to a player and controlling a payout device 244 to facilitate payment of the payout to the player. In some embodiments, the payout controller 242 may independently determine the amount of payout to be provided to the participant or player. In other embodiments, the payout controller 242 may be integrally implemented with the processor 202. The payout controller 242 may be a hopper controller, a print driver, credit-transmitting device, bill-dispensing controller, accounting software, or other controller device configured to verify and/or facilitate payment to a player.

A payout or payment device 244 may also be provided in gaming machine embodiments, where the payment device 244 serves as the mechanism providing the payout to the player or participant. In some embodiments, the payment device 244 may be a hopper, where the hopper serves as the mechanism holding the coins/tokens of the machine, and/or distributing the coins/tokens to the player in response to a signal from the payout controller 242. In other embodiments, the payout device 244 may be a printer mechanism structured to print credit-based tickets that may be redeemed by the player for cash, credit, or other casino value-based currency or asset. In yet other embodiments, the payout device 244 may send a signal via the network server 228 or other device to electronically provide a credit amount to an account associated with the player, such as a credit card account or player loyalty account. The computing arrangement 200 may also include accounting data stored in one of the memory devices 204, 206. This accounting data may be transmitted to a casino accounting network or other network to manage accounting statistics for the computing arrangement or to provide verification data for the currency or currency-based tickets distributed by the payout device, such as providing the data associated with the bar codes printed on the currency-based tickets so they are identifiable as valid tickets for a particular amount when the player redeems them or inserts them in another gaming device.

The wager input module or device 246 represents any mechanism for accepting coins, tokens, coupons, bills, electronic fund transfer (EFT), tickets, credit cards, smart cards, membership/loyalty cards, or any other player assets, for which a participant inputs a wager amount. The wager input device 246 may include magnetic strip readers, bar code scanners, light sensors, or other detection devices to identify and validate physical currency, currency-based tickets, cards with magnetized-strips, or other medium inputted into the wager input device. When a particular medium is received in the wager input device 246, a signal may be generated to establish or increase an available credit amount or balance stored in the internal memory/storage of the computing device 200, such as in the RAM 204. Thereafter, specific wagers placed on games may reduce the available credit amount, while awards won may increase the available credit amount. It will be appreciated that the primary gaming software 232 may be able to control payouts via the payment device 244 and payout controller 242 for independently determined payout events.

Among other functions, the computing arrangement 200 provides an interactive experience to players via an input interface 222 and output devices, such as the display 211, speaker 230, etc. These experiences are generally controlled by gaming software 232 that controls a primary gaming activity of the computing arrangement 200. The gaming software 232 may be temporarily loaded into RAM 204, and may be stored locally using any combination of ROM 206, drives 212, media player 214, or other computer-readable storage media known in the art. The primary gaming software 232 may also be accessed remotely, such as via the server 228 or the Internet.

The primary gaming software 232 in the computing arrangement 200 may be an application software module. According to embodiments of the present invention, this software 232 provides a slot game or similar game of chance as described herein. For example, the software 232 may present, by way of the display 211, representations of symbols to map or otherwise display as part of a slot based game having reels. However, in other embodiments, the principles of this concept may be applied to poker games or other types of games of chance. One or more aligned positions of these game elements may be evaluated to determine awards based on a pay table. The software 232 may include instructions to provide other functionality as known in the art or as described and shown herein.

The systems, apparatuses and methods operable via these and analogous computing and gaming devices can support gaming features as described herein. In one embodiment, a primary game is played, and an optional auxiliary feature may be activated by the player. Payout modifiers, such as credits to add to a primary payout, multipliers to apply to a primary payout, and other mathematical functions that can enhance the primary game payout, are randomly presented. In one embodiment, where the player has opted to partake in the auxiliary feature by providing some player asset, the auxiliary feature interacts with the primary gaming area to randomly identify payout modifiers, which if provided, may generally provide greater chances to enhance the primary payout based on the player assets offered by the player. Other embodiments involve gaming devices, gaming systems, and methods of operating these devices or systems to facilitate game play that utilizes operations of implementing random payout modifiers, such as multipliers, on gaming device game grids in response to receiving an auxiliary wager or special side wager. In one embodiment, a method of operating a gaming device includes providing a player the option of placing a side bet or wager to activate one or more random multipliers on the game grid.

Many embodiments are described in terms of a slot game, where typically randomly-presented symbols are matched to determine payout awards. However, the principles described herein are equally applicable to other games of chance, as described herein and as will be readily apparent to those skilled in the art from the teachings herein.

Figure 3:
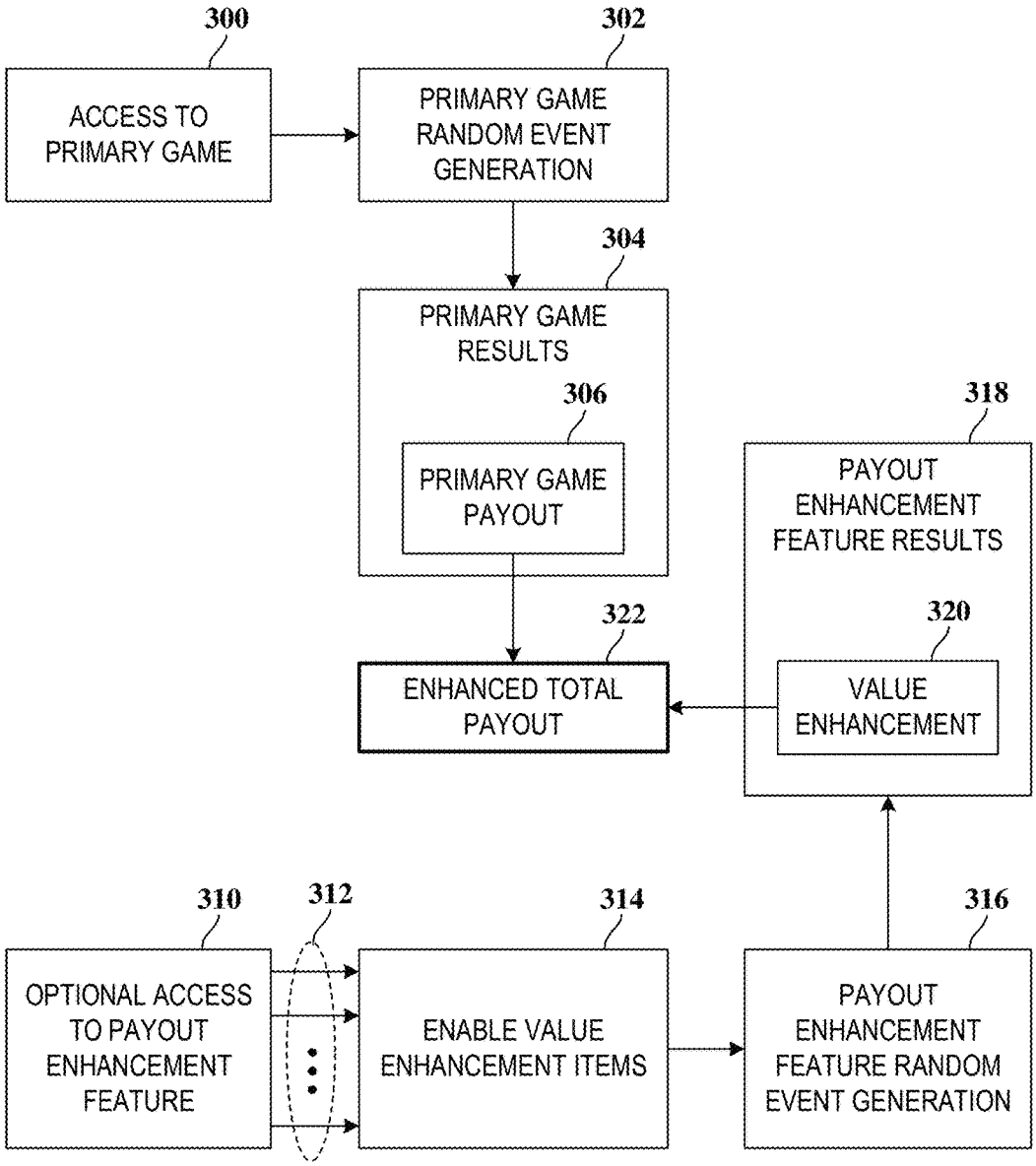
FIG. 3 is a block diagram illustrating an embodiment of an optional, wager-based auxiliary feature that interacts with a primary game to enhance payouts in the primary game.

FIG. 3 is a block diagram illustrating an embodiment of an optional, wager-based auxiliary feature that interacts with a primary game to enhance payouts in the primary game. The player may gain access 300 to a primary game, such as by paying money or allocating credits to participate in a gaming event of the primary game. An example is to allocate some number of banked credits on a slot game to cause the slot reels to spin, and ultimately provide a result. The reel spin or other generation of random game event elements (e.g., hand(s) dealt in a poker game, letters called in a bingo game, etc.) operate as the primary game random event generation 302. Thus, in a slot game, the primary game random event generation 302 may include spinning or otherwise randomizing symbol-populated reels and/or game indicia at respective symbol locations, and stopping the action to present symbols on the reels and/or in the symbol locations. The primary game results 304 can be determined when the symbols (e.g., slot game symbols, poker cards, etc.) have been presented to the player as the gaming event constituents. If the symbols, cards, and/or other game elements correspond to a winning result, a corresponding primary game payout 306 may be provided.

In accordance with the payout enhancement features described herein, a player may be provided access to the payout enhancement features 310. In one embodiment, access to such features is optional, such that the player would pay to gain access to the features. For example, if the player chooses not to partake in the payout enhancement feature, then the player does not make the additional wager beyond the standard wager to participate in the primary game. If the player would like to participate in the payout enhancement feature, an additional wager or side bet is placed by the player in one embodiment. Some embodiments involve a tiered wagering structure, such that, generally, the more that is wagered for the payout enhancement feature by the player, the more payout enhancement opportunities will be provided. For example, the player may be provided with the opportunity to purchase zero, one, or more, possibly up to some limit, of opportunities to enhance a primary game payout via the payout enhancement feature.

Depending on the level of access 312 selected by the player, a commensurate quantity of value enhancement items are enabled 314. For example, if the player paid to obtain two payout enhancement opportunities in the payout enhancement feature, then in one embodiment two value enhancement items (e.g., multipliers or other mathematical payout enhancements, additional credit awards, etc.) are enabled 314. The payout enhancement feature random event generation 316 then randomly determines whether any such value enhancement awards will be available for that reel spin or other gaming event, and if so, will provide a quantity and/or quality of enhancement items commensurate with what the player paid to obtain. An equal, lesser, or greater number of payout enhancement awards may be provided via the payout enhancement feature random event generation 316. Depending on whether, or how many, value enhancement awards are randomly provided via the payout enhancement feature random event generation 316, payout enhancement feature results 318 are provided. For example, the payout enhancement feature results 318 includes some number of game play item (e.g., symbol) upgrades, any payout modifiers such as multipliers, etc., which specify the value enhancement 320 to be apply to any primary game payout 306 or otherwise be directly awarded. For example, the value enhancement 320 may represent a 5× (five times) multiplier on a particular payline that provided a primary game payout 306 of 50 credits, providing an enhanced total payout 322 of 250 credits in this example.

Various examples are provided below, to facilitate an understanding of the concepts and teachings provided herein. The exemplary systems, apparatuses and methods described herein provide examples of manners of enhancing payouts in gaming activities based on a multi-level purchase option for payout enhancements and a multi-level grant of payout enhancements.

In one embodiment, players are allowed to place a wager on at least one of a plurality of available options to upgrade or "upconvert" a symbol(s) or other indicia in a gaming activity. A number of payout enhancement designators may be awarded, of a quantity within a range commensurate with the range of available purchase options. For example, in one embodiment, if the player is allowed to purchase between zero and five payout enhancement options, the number of payout enhancement designators that can be randomly awarded is in the range of zero and five. In other embodiments, the number of options available to the player and the number of randomly awarded payout enhancement designators may differ.

In one example, the player may be allowed to purchase zero, one, two, or three payout enhancement options, such as by allocating an appropriate number of credits on a gaming machine to the desired purchase option. When a gaming event (e.g., slot game reel spin) occurs, zero, one, two or three payout enhancement awards are made available to the player, some of which may be unusable to the player due to the player's prior failure to purchase enough payout enhancement options to use the number of payout enhancement awards that were granted. In one embodiment, the player is still presented with all of the granted payout enhancement awards that were made available, notwithstanding the player's inability to make use of one or more of such awards due to failure to purchase a sufficient number of options, so that the player can see what payout enhancement may have been lost as a result of the failure to purchase a sufficient number of the payout enhancement options.

As described in greater detail herein, the awards may include value-upgraded symbols (e.g., symbols with combinations providing lesser payouts are converted to symbols with combinations providing higher payouts), multipliers, multiplier-wild symbols (e.g., symbols serving both as wild symbols and providing a payout multiplier), and/or other desired payout enhancements. In one embodiment, the payout enhancements affect existing payouts, such as multiplying an existing payout by an awarded multiplier, while in other embodiments the payout enhancement may add to or complement existing payouts (e.g., an enhancement award of additional credits, free spins, etc.).

By allowing a plurality of different payout enhancement options to be purchased, and allowing a random number of payout enhancement awards to be potentially granted to the player in connection with a gaming event, the player risks under-purchasing, or in some cases over-purchasing, the options. This provides additional excitement and anticipation in any gaming activity in which such a feature is employed. For example, a player may purchase the maximum number of payout enhancement options, and in the case where the maximum number of payout enhancement awards are randomly granted, the first player would get the benefit of all of the payout enhancement awards that were granted. Alternatively, a player who purchased none of the payout enhancement options, where the maximum number of payout enhancement awards are randomly granted, would receive no benefit of the granted payout enhancement awards. Players could purchase some number of payout enhancement options where the granted payout enhancement awards are greater than those purchased, in which case the player may obtain benefit only from a number of the awards granted that corresponds to the number of options purchased, and forfeit any remaining awards that were granted. Players could also purchase some number of payout enhancement options, where the granted payout enhancement awards are less than those purchased, in which case the player receives benefit from those payout enhancement awards that were granted, but in one embodiment gains nothing from those purchased in addition to those granted.

Concepts described herein set forth, among other things, manners in which a player can purchase options to convert non-valuable (or less valuable) symbols to valuable (or at least more valuable) symbols. This may be described herein as upgrading or "upconverting" symbols to something of greater value than what was originally presented. In some embodiments, the original symbol that is available for upgrading may be a symbol still available for use in the game, such as a lower value symbol that provides lesser payouts if randomly provided in a paying combination. In other embodiments, the original symbol may have no value, and serve as a blocking symbol, such that it generally impedes other combinations of symbols that do have winning combinations that can provide payouts.

In some embodiments, locations of the randomly-designated symbol locations where symbol upconversion may take place (depending on the level of purchased options by the player) may be identified, and the ultimate payout enhancement award be separately presented. For example, a symbol grid in a slot game may be initially populated with symbols, and one or more of the symbols and/or symbol locations indicate that the symbol(s), or symbol(s) at the symbol location(s), are identified as awarded/granted payout enhancements. However, the player may not be able to use some or all of the awarded payout enhancements, depending on whether and how many payout enhancement options were purchased. For any that are awarded that were also purchased, a subsequent presentation may be provided of upgrading or otherwise changing the symbol at the symbol location to an upgraded symbol or award, where the non-purchased awards may remain as the original symbol (or in some cases the player may still be shown a value that was lost by failing to purchase enough options).

Thus, concepts described herein provide, among other things, a selectable number of options to upconvert individual symbols or other game indicia to more favorable symbols or other game indicia. Where the player chooses to purchase the maximum number of payout enhancement options, there is no concern of losing the benefit of a random grant of a commensurate maximum number of payout enhancement awards. Where the player chooses to purchase less than the maximum number of payout enhancement options, there is a risk of losing the benefit of any payout enhancement awards that exceed the number of options purchased. Where the player purchases less than the maximum number of payout enhancement options, the player may guess just right, such as where only one of a maximum of three options was purchased, but only one payout enhancement option was randomly awarded. The player may also weigh over-purchasing payout enhancement options, where more options are purchased than randomly provided in connection with a gaming event.

Figure 4:
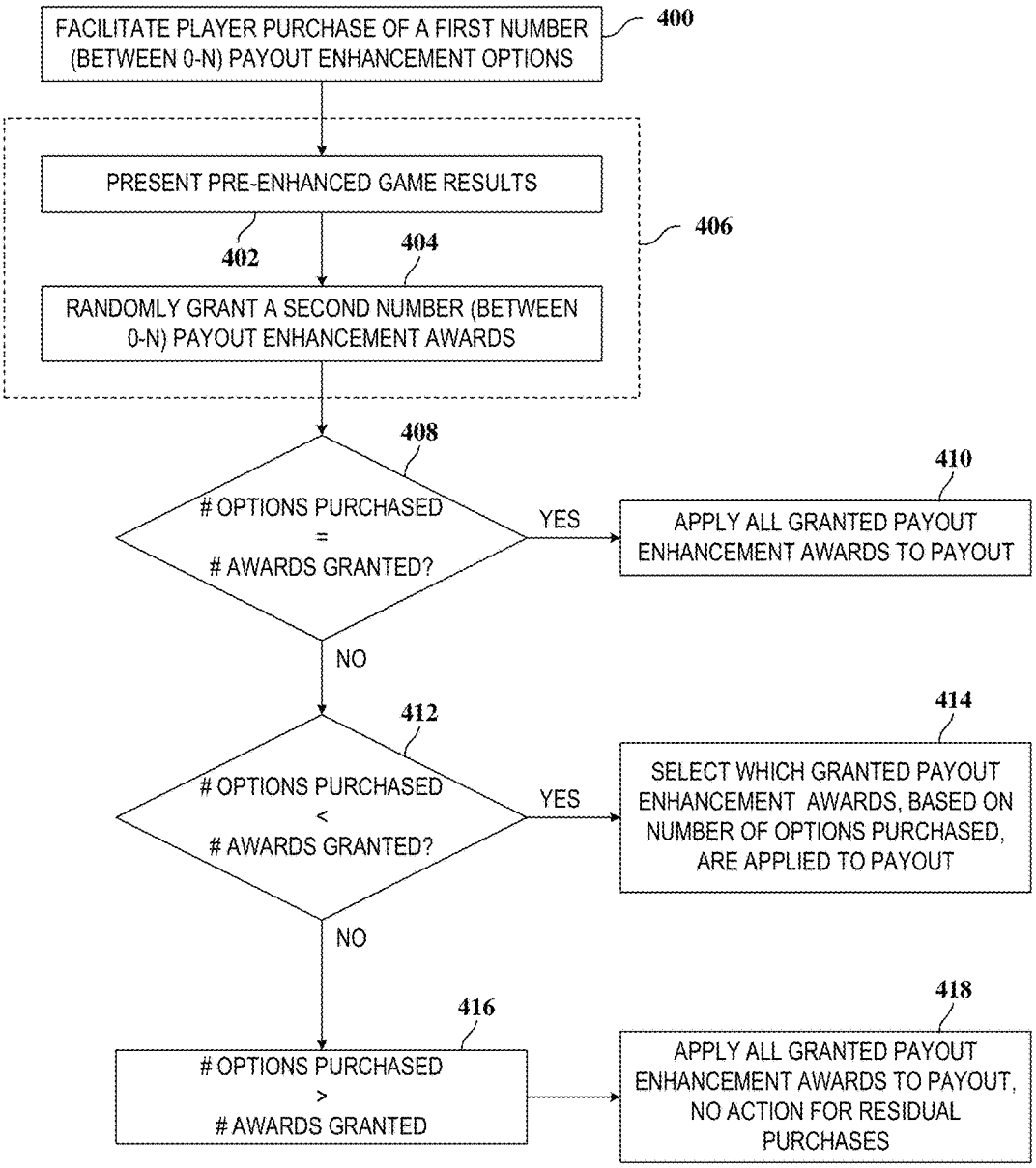
FIG. 4 is a flow diagram illustrating a representative embodiment for facilitating gaming payout enhancements through player purchase of a desired number of options to qualify to receive a commensurate quantity of a randomly-generated number of payout award enhancements.

FIG. 4 is a flow diagram illustrating a representative embodiment for facilitating gaming payout enhancements through player purchase of a desired number of options to qualify to receive a commensurate quantity of a randomly-generated number of payout award enhancements. The sequence of events of the flow of FIG. 4 may differ, as the particular sequence of events depicted is provided merely for purposes of facilitating an understanding of an embodiment.

The gaming system or device facilitates 400 player purchase of some number of payout enhancement options, where the number purchased is between 0-N (where N represents an indefinite number). In one embodiment, the purchase options include at least the opportunity to select zero, one, or two options. In this manner, if the player chooses to purchase any options, then a decision will be involved as to how many options to purchase. Therefore, in one embodiment, there are at least a plurality of non-zero purchase options available to the player.

Game results are presented 402, which represents game results before being enhanced by the features described herein. It should be recognized that, in other embodiments, the pre-enhanced game results may be presented 402 contemporaneously with payout enhancement awards provided via the features described herein. A number of payout enhancement awards, also between 0-N in one embodiment, are randomly granted 404. The payout enhancement awards may be granted after the presented 402 game results, or integral with the presentation 402 of the standard game results, as suggested by the dashed box 406.

Therefore, a player is allowed to purchase 400 a first number of payout enhancement options, and the game randomly grants 404 a second number of payout enhancement awards for use with the presented 402 game results. Depending on the number of payout enhancement options purchased by the player, relative to the number of payout enhancement awards granted, the player may receive none, one, some, or all of the granted payout enhancement awards. Additionally, the player may purchase a greater number of payout enhancement options than payout enhancement awards are granted, thereby creating a situation where players can decide how many payout enhancement options to purchase based on a sliding scale of monetary risk versus reward.

In the example of FIG. 4, if the number of options purchased by the player is equal to the number of payout enhancement awards granted as determined at decision block 408, all granted payout enhancement awards are applied 410 to the payout. Otherwise, the number of options purchased were not equal to the number of awards granted, and it is determined 412 whether the number of options purchased by the player is less than the number of payout enhancement awards granted. If so, this indicates that some granted awards will not be used in upgrading symbols and increasing payouts, although the number of granted payout enhancement awards corresponding to the number of payout enhancement options purchased will be available for use in upgrading symbols and increasing payouts. Particularly, in this instance, a subset of the number of granted payout enhancement awards are selected 414 to be applied to the game and consequent payout, where the number in the subset corresponds to the number of options purchased by the player. As an example, if the player purchased two options, and three payout enhancement awards were granted, two of the three granted awards will be selected 414 (e.g., randomly, or by player selection, or in a predetermined patterned or otherwise predictable fashion, etc.) on the game play area as active payout enhancement awards.

Finally, if the number of options purchased is not equal to or less than the number of awards granted, then the number of options purchased is greater than the number of awards granted, as depicted at block 416. This indicates that some of the funds used to purchase the options may not result in a return, but it did ensure that if the number of options purchased had resulted in an equal number of granted awards, the player would not have lost what could have been a high payout. Thus, in one embodiment, when purchasing a greater number of options than awards received, all granted payout enhancement awards are applied 418 to the payout, and there is no action for residual purchases. Again, the particular order of determining the quality or any quantity of options purchased relative to awards granted is irrelevant.

Figure 5A:
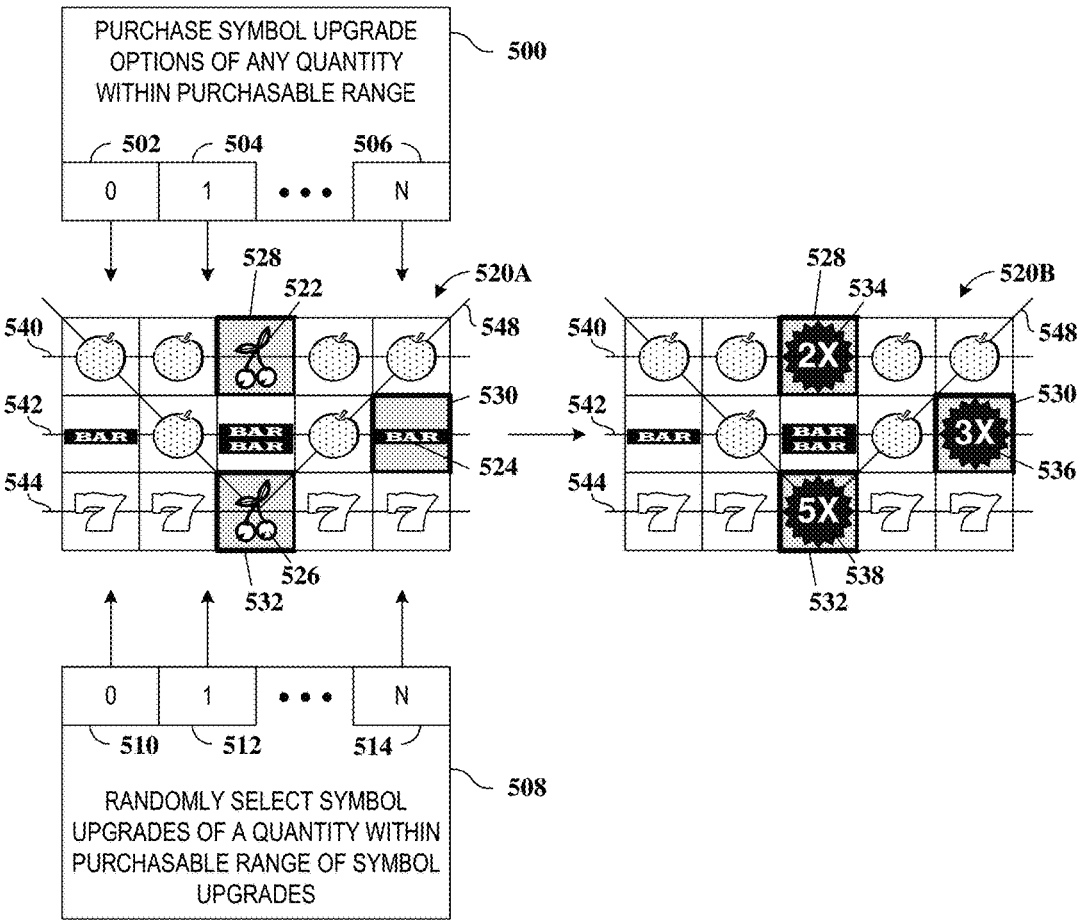
FIG. 5A depicts a representative example for facilitating slot game enhancements through player purchase of symbol upgrade options.

FIG. 5A depicts a representative example for facilitating slot game enhancements through player purchase of symbol upgrade options. The player is allowed to purchase 500 symbol upgrade options of any quantity within a purchasable range, which may be zero 502 purchased options, one 504 purchased option, up to some limit of purchasable options N 506. In connection with the gaming activity, some number of symbol upgrades are randomly selected 508 for use in the gaming event, which is a slot game reel spin in this example. The number of randomly selected symbol upgrades may be zero 510, one 512, up to some determined upper limit depicted by N 514. For example, if the number of randomly selected symbol upgrades was zero 510, the player would not be provided with any payout enhancement awards, regardless of whether or not the player purchased options to use any granted payout enhancement awards. In such case, payout results would be determined by the originally-presented symbol grid. In one embodiment, the maximum number of possible randomly selected 508 symbol upgrades is equal to the maximum number of symbol upgrade options available for purchase 500 by the player, although in other embodiments this maximum need not be equal.

The player may have purchased one or more symbol upgrade options, and the system may have randomly selected 508 one or more symbol upgrades. As described in connection with FIG. 4, depending on the number of options purchased relative to the number of awards granted, the player may have, in hindsight, over-purchased or under-purchased options for that particular reel spin event. For purposes of example, assume the player has opted to purchase 500 three options for slot symbol upconversion, and assume that the system has randomly selected 508 three symbol upgrades. Since the player purchased a number of options commensurate with the number of symbol upgrades awarded, the player will be able to use all of the awarded symbol upgrades. This is depicted on slot game grid 520A, where symbol locations 522, 524 and 526 have been randomly (or in other embodiments not randomly) identified as symbol locations where symbol upconversion will take place. In the embodiment of FIG. 5A, the original symbols 522, 524, 526 remain visible and their respective symbol locations 528, 530, 532 are highlighted, while in other embodiments the symbols themselves indicate that they are candidates for symbol upgrading, such as special or unique symbols, the use of sub-symbols, symbol variation, or the like. Since the player opted to purchase three symbol upgrade options, and because the system granted an equal number of symbol upgrade awards, all three of the symbols 522, 524, 526 will be upgraded in this example. The result of this upgrade is depicted at grid 520B, where new, upgraded symbols (or at least enhancement award identifiers) 534, 538, 538 now occupy symbol locations 528, 530, 532 respectively.

Referring to the pre-enhanced game play grid 520A, there are no winning symbol combinations on any paylines, including at least paylines 540, 542, 544 and 548. However, three payout enhancement awards were granted, providing an opportunity for the player to better the original gaming situation. Had the player not purchased 500 any options, then game grid 520A would not change, or at least would not enable use of the randomly selected 508 symbol upgrades 534, 536, 538 shown at game grid 520B. In this example, it is assumed that the player purchased three options, thereby benefitting the player with all three new upgraded symbols 534, 536, 538 at symbol locations 528, 530, 532 shown at game grid 520B.

In one embodiment, the upgrade symbols may all have a common trait, such as a wild functionality with some multiplier, as is the assumed case for the example of FIG. 5A. In other embodiments, the symbol upgrade/upconversion can be any betterment of the symbol quality, such as changing from a symbol associated with relatively low payouts to a symbol associated with relatively high payouts, providing a multiplier with the original symbol, making the symbol a wild symbol with or without a multiplier, etc. In this example, the upgrade symbols are considered to be wild-multipliers, meaning that they serve as any symbol (or some identified set of symbols) available in the game, while also potentially providing a multiplier value. In this example, upgrade symbol 534 is a 2×-wild symbol, upgrade symbol 536 is a 3×-wild symbol, and upgrade symbol 538 is a 5×-wild symbol.

The multipliers or other enhancements may apply to payouts on the entire slot game grid 520B, where being awarded multiple multipliers may combine to form a larger multiplier applicable to any and all payouts on the grid 520B. In other embodiments, the multipliers or other enhancements may apply to payouts occurring on paylines involving the symbol location of the respective upgraded symbol. The resulting upgraded symbols may be used in these or other manners, as desired for the particular game. In the example of FIG. 5A, it will be assumed that the wild-multipliers are operative for payouts on paylines that involve the symbol location of the respective upgraded symbol. Therefore, the 2×-wild symbol 534 at symbol location 528 is operative on at least payline 540. Before symbol upconversion, payline 540 of slot game grid 520A had no winning symbol combinations, and consequently no payout. After symbol upconversion, payline 540 of slot game grid 520B has a winning symbol combination of five like symbols, due to the upgraded symbol 534 which serves as a wild symbol and a 2× multiplier. Therefore, any payout on payline 540 will be multiplied by two.

Other symbol upgrades are treated similarly. The 3×-wild symbol 536 at symbol location 530 is operative on at least payline 542. Before symbol upconversion, payline 542 of slot game grid 520A had no winning symbol combinations, and consequently no payout. After symbol upconversion, payline 542 of slot game grid 520B still has no winning symbol combination, and therefore no payout. Thus, even though a symbol upgrade was awarded for a purchased symbol upgrade option does not, in some embodiments, ensure any monetary gain therefrom. The upconverted 5×-wild symbol 538 at symbol location 532 is operative on at least paylines 544 and 548. Before symbol upconversion, payline 544 of slot game grid 520A had no winning symbol combinations, and consequently no payout. After symbol upconversion, payline 544 of slot game grid 520B has a winning symbol combination of five like symbols, due to the upgraded symbol 538 which serves as a wild symbol and a 5× multiplier. Therefore, any payout on payline 544 will be multiplied by five. Additionally, before symbol upconversion, payline 548 (forming a "V" through the grid 520A/520B) of slot game grid 520A had no winning symbol combinations, and consequently no payout. After symbol upconversion, payline 548 of slot game grid 520B has a winning symbol combination of five like symbols, due to the upgraded symbol 538 which serves as a wild symbol and a 5× multiplier. Therefore, any payout on payline 548 will be multiplied by five.

Had the player purchased only one or two symbol upgrade options, desired rules will dictate which of the symbol upgrade awards will be activated for use for the player. For example, the example of FIG. 5A involved three randomly selected 508 symbol upgrades. Had the player purchased only one option, only one of the three symbol upgrades 534, 536, 538 would be available to the player. In such a case, one of the symbol upgrades 534, 536, 538 may be randomly selected for the user, may be selected in a certain pattern (e.g., farthest left, closest to top, highest multiplier, lowest multiplier, most beneficial in a payline, least beneficial in a payline, etc.), may be selected by the user, etc. Any desired manner of activating fewer than the total granted payout enhancement awards may be implemented for use with the features described herein.

Figure 5B:
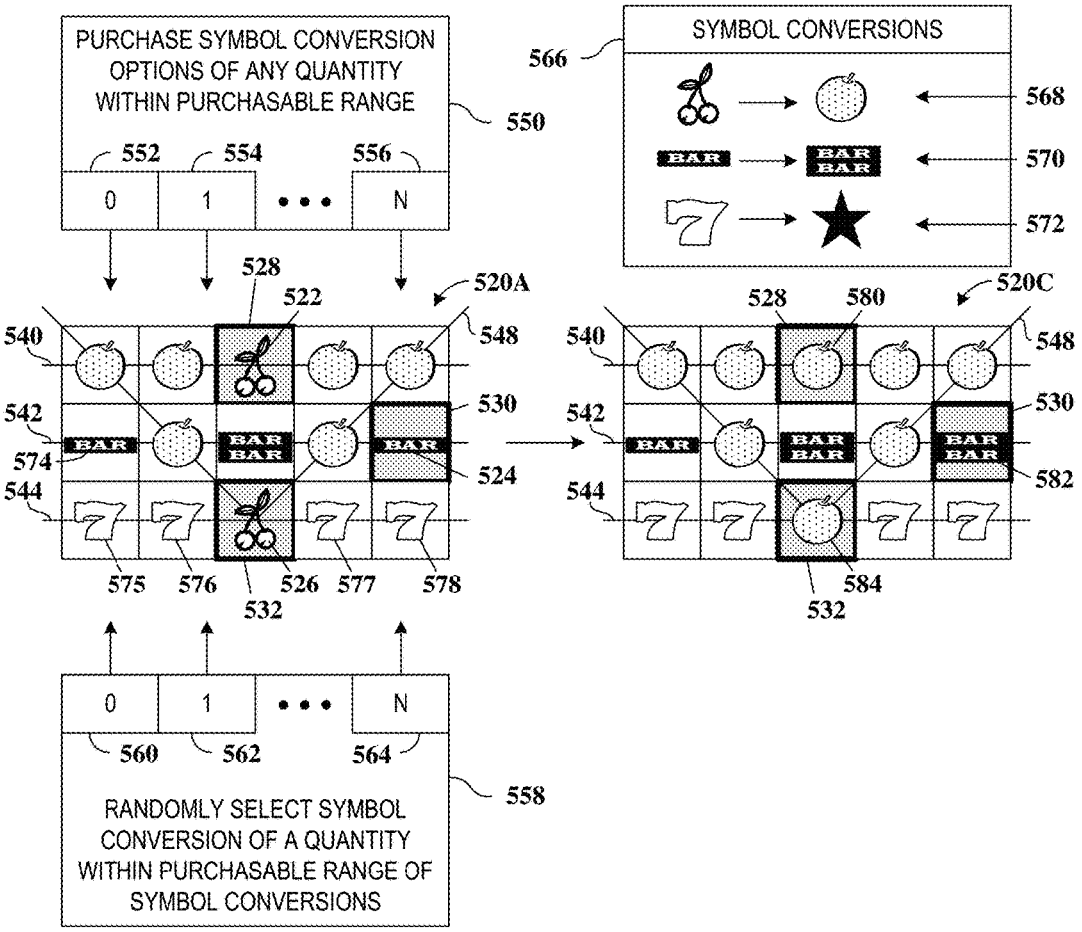
FIG. 5B depicts a representative example for facilitating slot game enhancements through player purchase of symbol conversion options to convert symbols to other symbols.

FIG. 5B depicts a representative example for facilitating slot game enhancements through player purchase of symbol conversion options. In such an embodiment, the player may be presented with the ability to purchase zero, one or more options to have symbols presented in connection with a reel spin (or other gaming event) converted to other symbols. In one embodiment, the "other symbols" in which the symbols are converted are randomly selected, such as during or after a reel spin event. If the player purchased an option(s) for symbol conversion, then in one embodiment a commensurate quantity of symbol conversions are available to the player. At any point after the player has decided whether and how many symbol conversion options to purchase, a number of symbol conversions are revealed to the player. For example, three symbol conversions may be presented to the player, such as, for example, converting cherry symbols to orange symbols, converting single-bar symbols to double-bar symbols, and converting bell symbols to star symbols. In one embodiment the symbol conversions are randomly selected on each reel spin, or could be randomly selected every X spins, could be known in advance, or a type of conversion may be known but not the specific conversions (e.g., card symbols to card symbols, fruit symbols to other fruit symbols, low value symbols to high value symbols, etc.). If the player opted to purchase any options to receive any of these symbol conversions, payouts may be made on the original symbol placement on the symbol grid, then the symbol grid is updated with the symbol conversions of those symbols in which options were purchased, and the symbol grid is reevaluated for payouts. This essentially enables a player to purchase zero, one or more options for randomly-presented symbol conversions that provide the player another chance to win on that reel spin by updating the symbols and reevaluating the symbol grid.

It should be recognized that in such a symbol conversion embodiment, the resulting symbols of the symbol conversion do not necessarily result in "better" symbols from the standpoint of being associated with higher payouts for like symbol combinations. Rather, the symbol conversions may result in symbols of lesser potential for higher payouts, but because the conversion adds these converted symbols to the grid and enables reevaluation for payouts, it may result in a winning payout, or improved winning payout, with the "lesser potential" converted symbols. Also, one, more or all of the resulting converted symbols are symbols from the reels housing the original, pre-converted symbols in one embodiment, while in other embodiments one, more or all of the resulting converted symbols may be new or different relative to symbols already being used in the gaming event.

The symbol conversions made available may occur randomly, such that on some reel spins no symbol conversions are available while on other reel spins the maximum number of symbol conversions are available, or anything in between. In other embodiments, the number of available symbol conversions may be fixed (e.g., equaling the maximum number of options available for purchase), or fixed within a range (e.g., always within one symbol conversion and the maximum number of options available for purchase), etc.

Referring to FIG. 5B, the player is allowed to purchase 550 symbol conversion options of any quantity within a purchasable range, which may be zero 552 purchased options, one 554 purchased option, up to some limit of purchasable options N 556. In connection with the gaming activity, some number of symbol conversions are randomly selected 558 for use in the gaming event, which is a slot game reel spin in this example. The number of randomly selected symbol conversions may be zero 560, one 562, up to some determined upper limit depicted by N 564. For example, if the number of randomly selected symbol upgrades was zero 560, the player would not be able to be provided with any symbol conversions, regardless of whether or not the player purchased options to use any such symbol conversions. In such case, payout results would be determined by the originally-presented symbol grid. In one embodiment, the maximum number of possible randomly selected 558 symbol upgrades is equal to the maximum number of symbol conversion options available for purchase 550 by the player, although in other embodiments this maximum need not be equal.

The player may have purchased one or more symbol conversion options, and the system may have randomly selected 558 one or more symbol conversions. For purposes of example, assume the player has opted to purchase 550 three options for slot symbol conversion, and assume that the system has randomly selected 558 three symbol conversions. Since the player purchased a number of options commensurate with the number of symbol conversions awarded, the player will be able to use all of the awarded symbol conversions. The symbol conversions may be made at different places and in different manners in different embodiments. In one embodiment, the symbols identified for conversion may be randomly selected on the symbol grid.

In another embodiment, all symbols of the type randomly selected may be replaced. For example, in an embodiment where all symbols of the type that is randomly selected are replaced, an example is that five cherry symbols are presented on the grid 520A, and the random selection 558 of symbols to convert to includes a conversion from a cherry symbol to an apple symbol, then all five of the cherry symbols would be changed to apple symbols if the player had purchased enough options and obtained this conversion. Further, if the random selection 558 also included a second conversion, such as a single-bar symbol to a double-bar symbol, then all single-bar symbols on the grid 520A would be converted to double-bar symbols if the player had purchased enough options and obtained this conversion. Thus, one embodiment involves randomly selecting 558 a number of symbols (e.g., 0, 1, 2 or 3 in one embodiment), and any symbols selected 558 that appear on the grid 520A will be replaced by a conversion symbol. The conversion symbols may be presented in any desired manner, such as, for example, a display 566, which may be integral to the slot grid 520A, on a separate display unit, or anywhere desired. In this example, the display 566 shows that three symbol conversions were randomly selected 558, including a cherry to apple conversion 568, a single-bar to double-bar conversion 570, and a seven to star conversion 572. If this occurred in an embodiment where all symbols of that type were converted as randomly selected 558 and displayed via display 566, then cherry symbols 522 and 526 would be converted to apple symbols (based on cherry to apple conversion 568), single-bar symbols 524 and 574 would be converted to double-bar symbols (based on single-bar to double-bar conversion 570), and all seven symbols 575, 576, 577, 578 would be converted to star symbols (based on seven to star conversion 572). Accordingly, the symbol conversion or upgrades described herein may enable symbols to convert to other symbols, and the symbols or symbol locations in which symbols are randomly selected may be converted based on symbol location, symbol type, and/or other criteria.

In one embodiment, symbol conversion occurs based on randomly-selected symbols or symbol locations. An example is depicted on slot game grid 520A (also used in connection with FIG. 5A), where symbol locations 522, 524 and 526 have been randomly (or in other embodiments not randomly) identified as symbol locations where symbol conversion will take place. In the embodiment of FIG. 5B, the original symbols 522, 524, 526 remain visible and their respective symbol locations 528, 530, 532 are highlighted, while in other embodiments the symbols themselves indicate that they are candidates for symbol conversion, such as special or unique symbols, the use of sub-symbols, symbol variation, or the like. Since the player opted to purchase three symbol conversion options, and because the system granted an equal number of symbol conversion awards, all three of the symbols 522, 524, 526 will be converted in this example. The result of this upgrade is depicted at grid 520C, where converted symbols 580, 582, 584 now occupy symbol locations 528, 530, 532 respectively. This result is based on the selection 558 of symbol conversions that is revealed at display 566.

As can be seen from the example of FIG. 5B, the conversion of symbols on grid 520C proved to be of value to the player, even though the particular resulting/converted symbols may not be "high value symbols." By converting cherry symbols 522, 526 to apple symbols 580, 584 as noted by conversion 568 on display 566, payouts for strings of apple symbols on paylines 540 and 548 become available when the grid 520C is reevaluated after symbol conversion.

Had the player purchased only one or two symbol conversion options, desired rules will dictate which of the symbol conversion awards will be activated for use for the player. For example, the example of FIG. 5B involved three randomly selected 558 symbol conversions, shown via display 566. Had the player purchased only one option, only one of the three symbol conversions 568, 570, 572 would be available to the player. In such a case, one of the symbol conversions 568, 570, 572 may be randomly selected for the user, may be selected in a certain pattern (e.g., farthest left, closest to top, highest multiplier, lowest multiplier, most beneficial in a payline, least beneficial in a payline, etc.), may be selected by the user, etc. Any desired manner of activating fewer than the total granted payout enhancement awards may be implemented for use with the features described herein.

It should be noted that descriptions provided herein referring to symbol upgrades and those referring to symbol conversions are interchangeable. In other words, whether a symbol upgrade/conversion results in a more favorable symbol or not, the principles described herein are equally applicable.

Figure 6A:
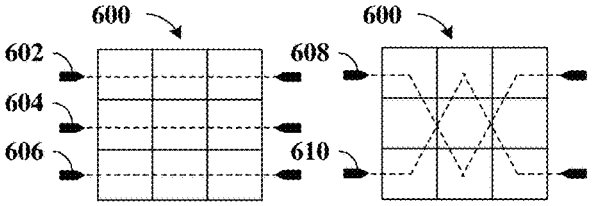
FIGS. 6A and 6B depict examples of representative payout determination methodologies in a slot game context that may be implemented in accordance with the disclosed payout enhancement features.
Figure 6B:
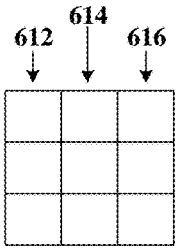

Further representative examples are now described in connection with FIGS. 7A-7D, 8A-8D, 9A-9D and 10A-10D. These figures provide representative manners in which payout enhancement options may be purchased and payout enhancement awards provided. The examples are set in the context of slot games, and assume a 3×3 slot game grid, although the principles are equally applicable to any slot game grid size, or other wagering game. The examples also assume that the symbol upgrades are wild-multipliers, although additional and/or different symbol upgrades may be employed in an analogous fashion. For purposes of these examples, it is also assumed that the slot games have a plurality of paylines, such as depicted in FIG. 6A. The number, paths, orientation and other features of the paylines may be however desired, although for purposes of the description of FIGS. 7A-7D, 8A-8D, 9A-9D and 10A-10D, only five paylines will be considered, including horizontal paylines 602, 604 and 606, and non-linear paylines 608, 610. Any other symbol-matching configurations may also be used. One such example of a non-payline configuration that may be used is shown in FIG. 6B, which represents a multiway payout methodology having no set paylines, but rather winning payouts are determined based on consecutive symbols in any position from left to right, namely from the left column 612, to the middle column 614, to the right column 616. Again, while any number of payout methodologies may be utilized in connection with the features described herein, the description of FIGS. 7A-7D, 8A-8D, 9A-9D and 10A-10D will be described in terms of 3×3 slot games that utilize paylines. It will also be assumed for purposes of these examples that the maximum number of payout enhancement options, and payout enhancement awards, is three, although any maximum limit for the particular game may be set.

Figure 7A:
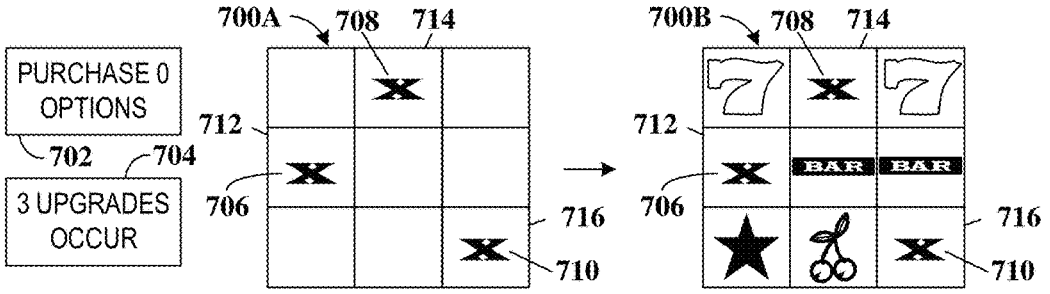
FIGS. 7A-7D depict examples of slot symbol upgrade features where three symbol upgrades are provided for different purchase options selected by the player.

Referring now to FIGS. 7A-7D, an example is provided where a slot game awards the maximum of three (for example) symbol upgrades in connection with a particular slot game reel spin event. In the example of FIG. 7A, the player purchased no options (zero options) to obtain any randomly awarded payout enhancement awards as depicted at block 702, while the game randomly provided three symbol upgrades as depicted by block 704. Symbol grid 700A shows the random identification of the locations of where the three symbol upgrades will be available, using "X" symbols 706, 708, 710 at respective symbol locations 712, 714, 716 to denote the positions in this example. The "X" symbols may be actual symbols used in symbol combinations, and/or may be blocking symbols (e.g., being associated with no symbol payline wins). In other embodiments, the symbols may otherwise be on the reel strips whereby the random occurrence of the X symbol on the reel strips provides the random payout enhancement award and slot grid 700A placement. In other embodiments, the actual upgraded symbol may be immediately placed, whether the underlying enhancement value is immediately revealed, or hidden until some further action occurs (e.g., a player selection, a system selection, etc.).

Figure 7B:
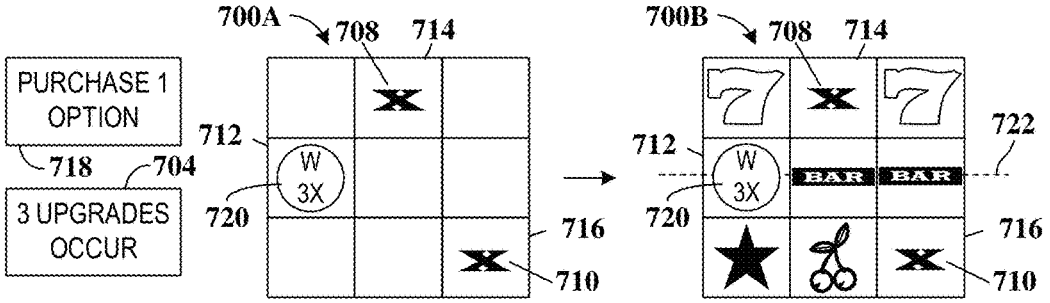

Because the player chose not to purchase any payout enhancement options in the example of FIG. 7A, the blocking symbols do not change to the upgraded symbols, as can be seen at the populated slot game grid 700B, where no payouts or enhancements thereto occurred. In the example of FIG. 7B, the player purchased one option to obtain up to one randomly awarded payout enhancement award as depicted at block 718, while the game randomly provided three symbol upgrades as depicted by block 704. Symbol grid 700A is again depicted, showing the random identification of the symbol locations 712, 714, 716 where the three symbol upgrades will be available. Here, because the player opted to purchase one option (block 718), two of the symbols, such as randomly selected symbols 708, 710, will remain "X" or blocking symbols, while the other randomly selected symbol is converted to a 3×-wild symbol 720. The symbol 720 is converted because the player purchased one option for upconversion, although the symbols 708 or 710 may have alternatively been the subject of the upgrade. Because the player chose to purchase one symbol upgrade option in the example of FIG. 7B, the two blocking symbols 708, 710 do not change to the upgraded symbols, as can be seen at the populated slot game grid 700B of FIG. 7B. However, the upgraded symbol 720 does provide a winning payout on payline 722, as the wild functionality enables three like symbols along payline 722 to occur, together with a 3× multiplier to multiply the resulting symbol combination payout by three.

Figure 7C:
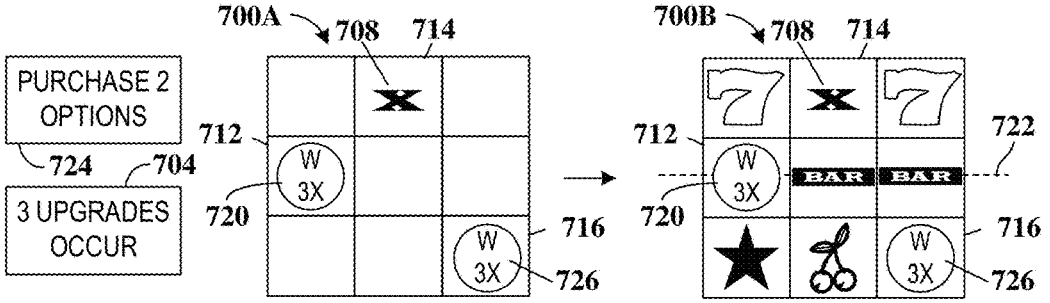

In the example of FIG. 7C, the player purchased two options to obtain up to two randomly awarded symbol upgrades as depicted at block 724, while the game randomly provided three symbol upgrades as depicted by block 704. Symbol grid 700A is again depicted, showing the random identification of the symbol locations 712, 714, 716 where the three symbol upgrades will be available. Here, because the player opted to purchase two options (block 724), one of the symbols, such as randomly selected symbol 708, will remain an "X" or blocking symbol, while the other randomly selected symbols are converted to 3×-wild symbols 720, 726. One or more of the symbols could be changed to upgraded symbols that are not wild-multiplier symbols, or not 3×-wild symbols, however 3×-wild symbols are used in these examples for purposes of illustration. The symbols 720 and 726 are upconverted because the player purchased two options for upconversion, although the two particular symbols of the three available could have been selected differently. Because the player chose to purchase two symbol upgrade options in the example of FIG. 7C, the remaining blocking symbol 708 does not change to an upgraded symbol, as can be seen at the populated slot game grid 700B of FIG. 7C. The upgraded symbol 720 does provide a winning payout on payline 722, as the wild functionality enables three like symbols along payline 722 to occur, together with a 3× multiplier to multiply the resulting symbol combination payout by three. The upgraded symbol 726 does not, however, provide a winning payout in this example, notwithstanding its upconversion from a lesser symbol.

Figure 7D:
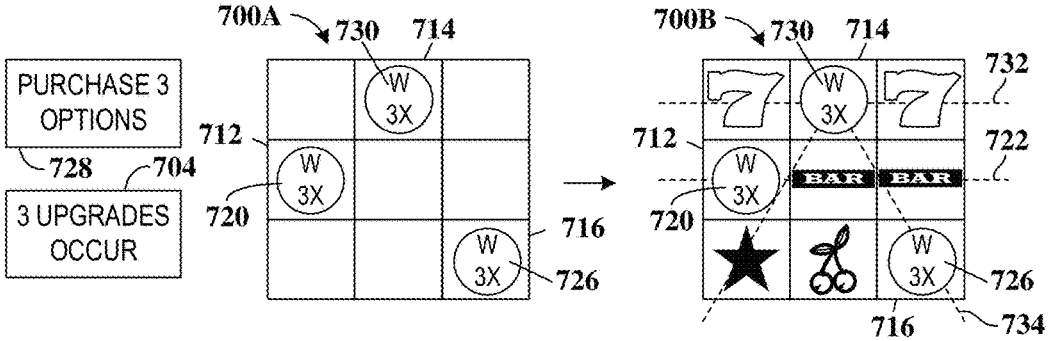

In the example of FIG. 7D, the player purchased three options to obtain up to three randomly awarded symbol upgrades as depicted at block 728, while the game randomly provided three symbol upgrades as depicted by block 704. Symbol grid 700A is again depicted, showing the random identification of the symbol locations 712, 714, 716 where the three symbol upgrades will be available. Here, because the player opted to purchase all three available options (block 728), none of the symbols will remain an "X" or blocking symbol. Since three symbol upgrades were randomly provided as seen at block 704, all three purchased symbol upgrade options are utilized, resulting in the conversion of symbols at symbol locations 712, 714, 716 to 3×-wild symbols 720, 730, 726 respectively. The symbols 720, 726 and 730 are upgraded because the player purchased three options for upconversion. As seen at slot game grid 700B of FIG. 7D, the 3×-wild symbols result in wins on payline 722 (three "bar" symbols), payline 732 (three "7" symbols), and payline 734 (three "star" symbols).

Again, examples of FIGS. 7A-7D assume only five paylines, such as depicted in connection with FIG. 6A, otherwise more, less, and/or different paylines may result in different results. Also, it is assumed that any symbol may be used to designate the locations in which symbol upgrades will occur. For example, a standard symbol may be presented at the particular location, with a sub-symbol that indicates it is a symbol available for upconversion if a corresponding option was purchased by the player and that particular symbol location is selected. The symbol used to designate the locations for symbol upgrades may also be blocking symbols, such as the "X" symbols depicted in FIGS. 7A-7D, that are not part of the standard reel strips. In another embodiment, the symbol used two designate the locations in which symbol upgrades will occur may be symbols from the actual reel strips, but may be a low value or special symbol.

Figure 8A:
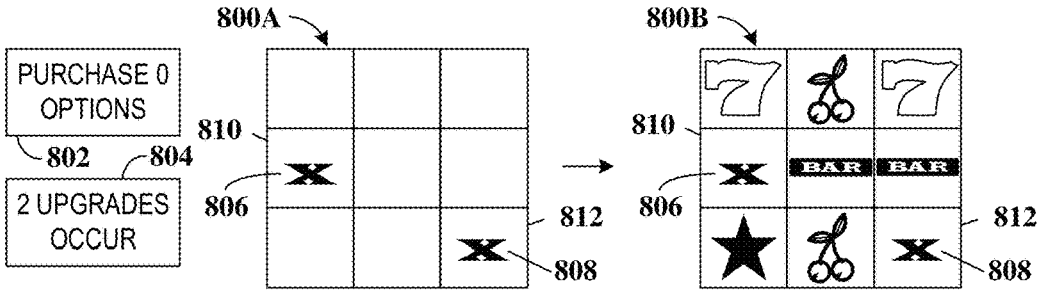
FIGS. 8A-8D depict examples of slot symbol upgrade features where two symbol upgrades are provided for different purchase options selected by the player.

Referring now to FIGS. 8A-8D, an example is provided where a slot game awards two of the maximum three (in this example) symbol upgrades in connection with a particular slot game reel spin event. In the example of FIG. 8A, the player purchased no options to obtain any randomly awarded payout enhancement awards as depicted at block 802, while the game randomly provided two symbol upgrades as depicted by block 804. Symbol grid 800A shows the random identification of the locations of where the two symbol upgrades will be available, using "X" symbols 806, 808 at respective symbol locations 810, 812 to denote the positions in this example. Because the player chose not to purchase any symbol upgrade options in the example of FIG. 8A, the blocking symbols do not change to upgraded symbols, as can be seen at the populated slot game grid 800B, where no payouts or enhancements thereto occurred.

Figure 8B:
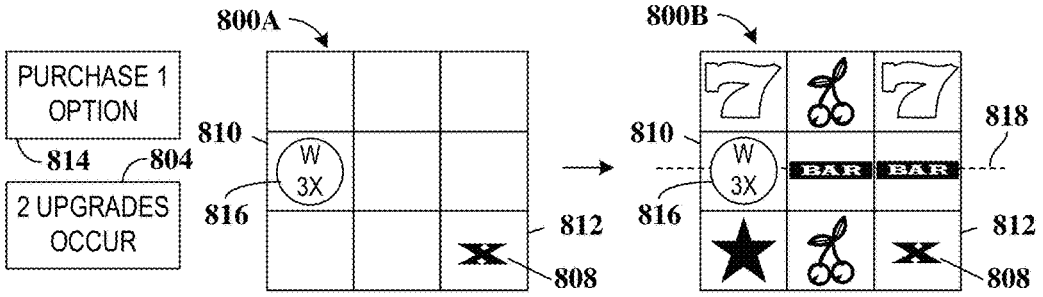

In the example of FIG. 8B, the player purchased one option to obtain up to one randomly awarded payout enhancement award as depicted at block 814, while the game randomly provided two symbol upgrades as depicted by block 804. Symbol grid 800A is again depicted, showing the random identification of the symbol locations 810, 812 where the two symbol upgrades will be available. Here, because the player opted to purchase one option (block 814), one of the symbols, such as randomly selected symbol 808, will remain an "X" (e.g., blocking symbol, low value symbol, special symbol not on reel strip, etc.), while the other randomly selected symbol is converted to a 3×-wild symbol 816. The symbol 816 is converted because the player purchased one option for upconversion, although the symbol 808 may have alternatively been the subject of the upgrade. Because the player chose to purchase one symbol upgrade option in the example of FIG. 8B, the blocking symbol 808 did not change to an upgraded symbol, as can be seen at the populated slot game grid 800B of FIG. 8B. However, the upgraded symbol 816 does provide a winning payout on payline 818, as the wild functionality enables three like symbols along payline 818 to occur, together with a 3× multiplier to multiply the resulting symbol combination payout by three.

Figure 8C:
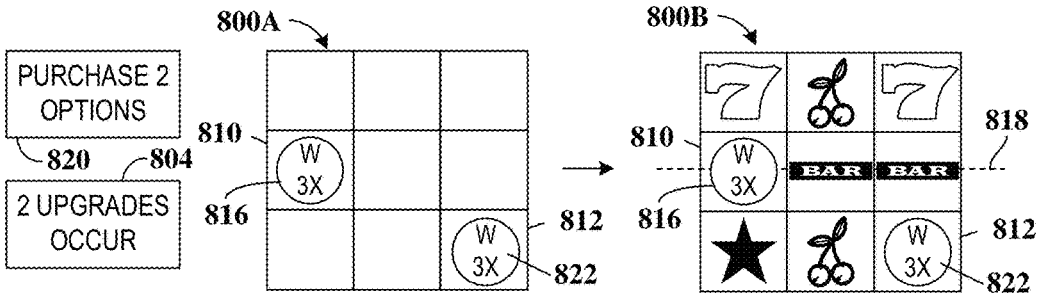

In the example of FIG. 8C, the player purchased two options to obtain up to two randomly awarded symbol upgrades as depicted at block 820, while the game randomly provided two symbol upgrades as depicted by block 804. Symbol grid 800A is again depicted, showing the random identification of the symbol locations 810, 812 where the two symbol upgrades will be available. Here, because the player opted to purchase two options (block 820), and because two upgrades occurred as indicated at block 804, none of the symbols remains an "X" or blocking symbol. Each of the awarded upgrades cause conversion of the symbols to 3×-wild symbols 816, 822. Both the original symbols 806, 808 are upconverted to upgrade symbols 816, 822 because the player purchased 820 two options for upconversion, and two upgrades 804 occurred. The upgraded symbol 816 provides a winning payout on payline 818, as the wild functionality enables three like symbols along payline 818 to occur, together with a 3× multiplier to multiply the resulting symbol combination payout by three. The upgraded symbol 822 does not, however, provide a winning payout in this example, notwithstanding its upconversion from a lesser symbol.

Figure 8D:
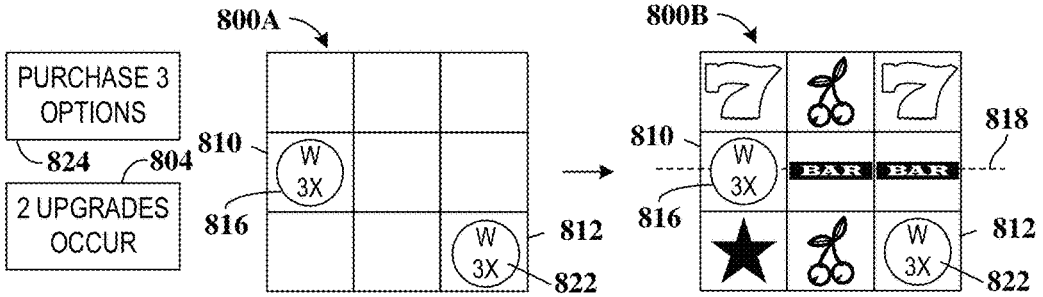

In the example of FIG. 8D, the player purchased three options to obtain up to three randomly awarded symbol upgrades as depicted at block 824, while the game randomly provided two symbol upgrades as depicted by block 604. Because the player purchased more symbol upgrade options than were randomly provided for the particular reel spin event, only two of the three purchases options can be used. Therefore, the player purchased more than required to obtain the maximum number of symbol upgrades for that spin, but the player may choose to purchase the maximum number of symbol on reel spins so that symbol upgrades are not lost when larger numbers of symbol upgrades are awarded. The resulting situation of FIG. 8D is therefore analogous to that of FIG. 8C, where both the original symbols 806, 808 are upconverted to upgrade symbols 816, 822 because the player purchased 824 more options than were awarded 804. The upgraded symbol 816 provides a winning payout on payline 818, as the wild functionality enables three like symbols along payline 818 to occur, together with a 3× multiplier to multiply the resulting symbol combination payout by three. The upgraded symbol 822 does not, however, provide a winning payout in this example, notwithstanding its upconversion from a lesser symbol.

Figure 9A:
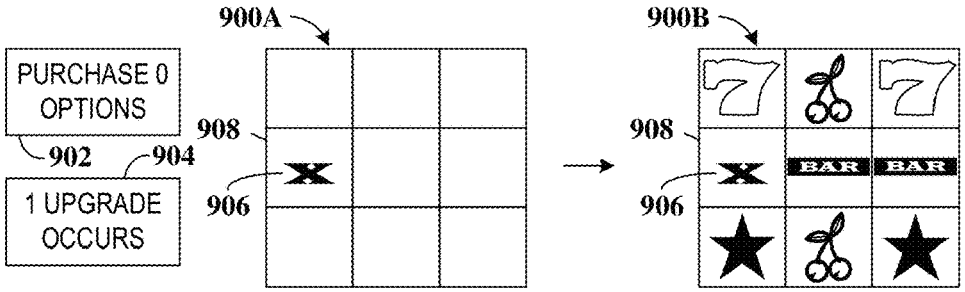
FIGS. 9A-9D depict examples of slot symbol upgrade features where one symbol upgrade is provided for different purchase options selected by the player.

Referring now to FIGS. 9A-9D, an example is provided where a slot game awards one of the maximum three (in this example) symbol upgrades in connection with a particular slot game reel spin event. In the example of FIG. 9A, the player purchased no options to obtain any randomly awarded payout enhancement awards as depicted at block 902, while the game randomly provided one symbol upgrade as depicted by block 904. Symbol grid 900A shows the random identification of the location where the symbol upgrade will be available, using an "X" symbol 906 at symbol location 908 to denote its randomly-selected position in this example. Because the player chose not to purchase any symbol upgrade options in the example of FIG. 9A, the blocking symbol 906 does not change to an upgraded symbol when awarded, as can be seen at the populated slot game grid 900B, where no symbol upconversion occurred and no payouts or enhancements thereto occurred.

Figure 9B:
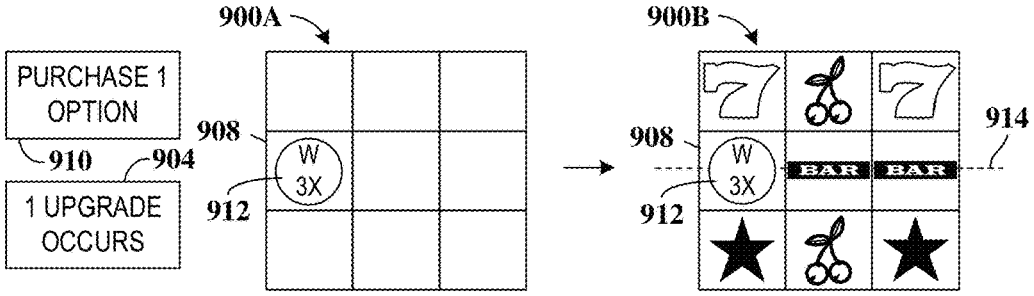

In the example of FIG. 9B, the player purchased one option to obtain up to one randomly awarded payout enhancement award as depicted at block 910, while the game randomly provided one symbol upgrade as depicted by block 904. Symbol grid 900A shows the random identification of the symbol location 908 where the symbol upgrade will be available. Here, because the player opted to purchase one option (block 910), and because one upgrade occurred as indicated at block 904, none of the symbols remains an "X" or blocking symbol. The awarded upgrade causes conversion of the symbol to a 3×-wild symbol 912 in this example. The original symbol 906 is upconverted to upgrade symbol 912 because the player purchased 910 one option for upconversion, and one upgrade 904 occurred. The upgraded symbol 912 provides a winning payout on payline 914, as the wild functionality enables three like symbols along payline 914 to occur, together with a 3× multiplier to multiply the resulting symbol combination payout by three.

Figure 9C:
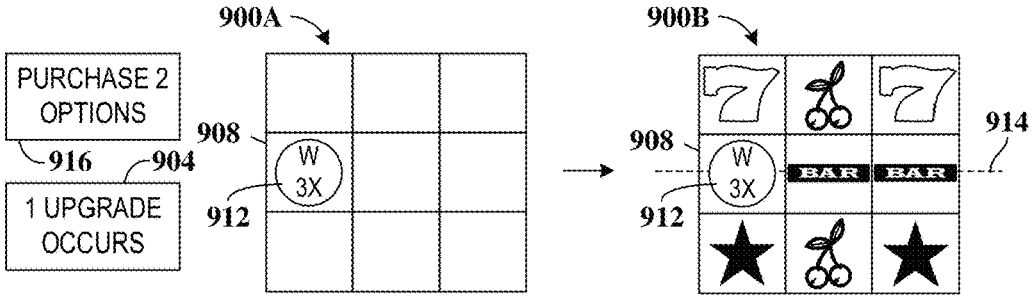
Figure 9D:
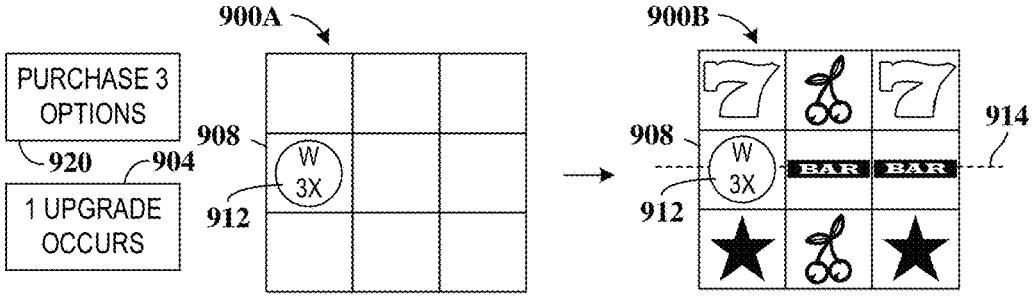

In the example of FIGS. 9C and 9D, the player purchased more symbol upconversion options than were provided in the gaming event. In the example of FIG. 9C the player purchased two options to obtain up to two randomly awarded symbol upgrades as depicted at block 916, and in the example of FIG. 9D the player purchased 3 options two obtain up to three randomly awarded symbol upgrades as depicted at block 920. In the examples of FIGS. 9C and 9D, the game randomly provided one symbol upgrade as depicted by block 904. Symbol grid 900A shows a random identification of the symbol location 908 where the symbol upgrade will be available. Here, because the player opted to purchase either 2 options (block 916) or 3 options (block 920), and because one upgrade occurred as indicated at block 904, none of the symbols remains an "X" or blocking symbol. The awarded upgrade causes conversion of the symbol to 3×-wild symbols 912. The original symbol 906 is upconverted to upgrade symbol 912 because the player purchased 916 a greater number of options for upconversion than that which were awarded. The upgraded symbol 912 provides a winning payout on payline 914, as the wild functionality enables three like symbols along payline 914 to occur, together with a 3× multiplier to multiply the resulting symbol combination payout by three. The resulting situation of FIGS. 9C and 9D is therefore analogous to that of FIG. 9B, where the original symbol 906 was upconverted to upgrade symbol 912 because the player purchased 916, 920 more options than were awarded 904.

Figure 10A:
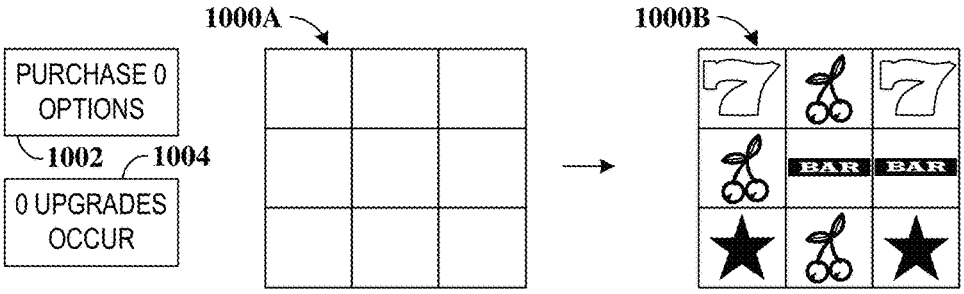
FIGS. 10A-10D depict examples of slot symbol upgrade features where no symbol upgrades are provided for different purchase options selected by the player.
Figure 10B:
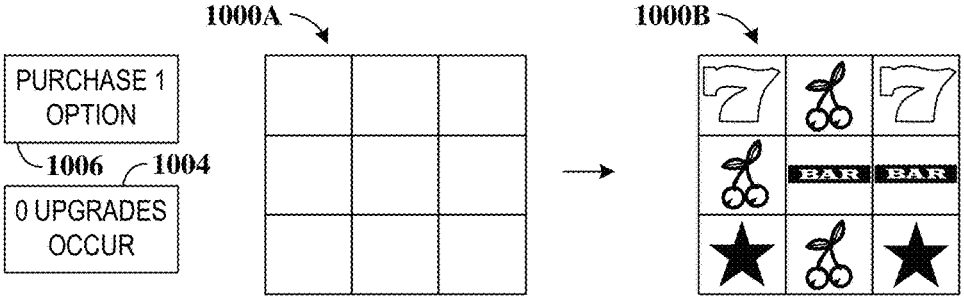
Figure 10C:
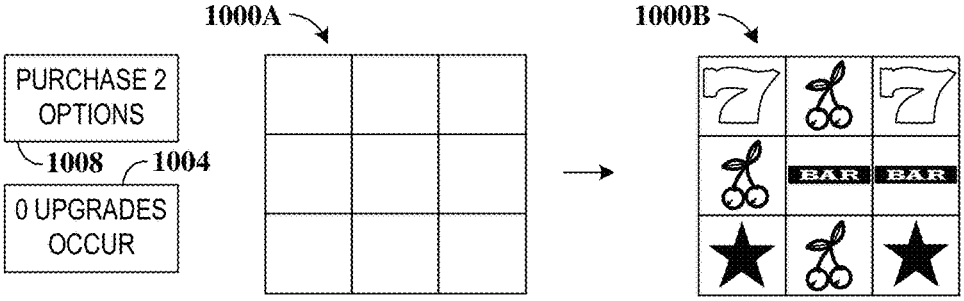
Figure 10D:
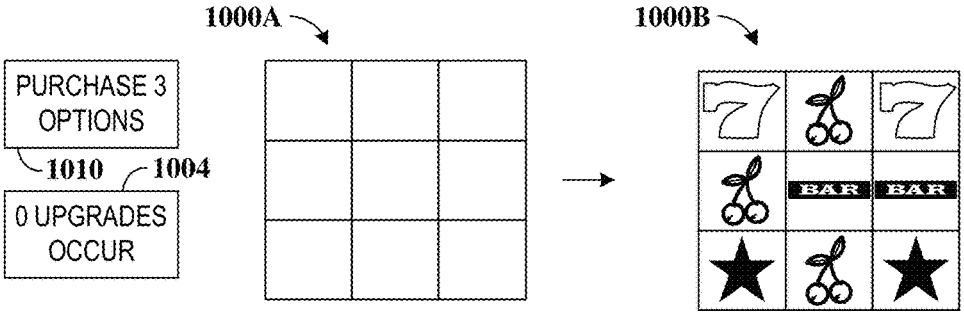

FIGS. 10A-10D represent a special case, where no payout enhancement awards e.g., symbol upgrades) occur for any of the player purchase scenarios. In the example of FIG. 10A, the player purchased no options to obtain any randomly awarded payout enhancement awards as depicted at block 1002, and the game provided no symbol upgrades as depicted by block 1004. In this situation, any game payouts stem solely from the primary game, and what is provided on slot game grid 1000A remains the same on slot game grid 1000B, as no award symbols/locations on grid 1000A occurred to change the final result on slot game grid 1000B. Similarly, in FIGS. 10B, 10C and 10D respectively, regardless of whether the player purchased one option 1006, two options 1008, or three options 1010, no upgrades occurred as depicted by blocks 1004. Therefore, in the case of FIGS. 10B, 10C and 10D, the player purchased more symbol upconversion options than were provided in the gaming event.

Therefore, for slot games such as those described in connection with FIGS. 7A-7D, 8A-8D, 9A-9D and 10A-10D, the player may optionally choose a number of symbol upgrade options to purchase as a side bet, part of an overall bet, or other wager. Examples such as those described in connection with FIGS. 7A-7D, 8A-8D, 9A-9D and 10A-10D support a variety of embodiments. One such embodiment involves random multipliers activated by a side bet or wager, where awarded symbol upgrades are presented in a manner as to emphasize the conversion into a more desirable game symbol. For example, a normal symbol, special symbol, blocking symbol, no symbol or blank symbol, and/or other symbol may first be presented at the symbol locations that will be upgraded when symbol upgrade awards are granted. In other embodiments, the symbol upgrade awards may initially be presented at their respective symbol locations, with limited or no special presentation or conversion anticipation.

In one embodiment, the conversion may be in a whack-a-mole style multiplier feature. The game may be a line game, multiway game, or any other payout determination methodology. The player may have the option to place some number of bonus bets, such as 1, 2, or 3 bonus bets, thereby respectively buying 1, 2, or 3 whack-a-mole swings per spin. In one such embodiment, after each spin, 1, 2, or 3 symbols may "open" and a multiplier mole may appear through a hole in the symbol. In some instances, zero symbols open in the play grid is not changed for any symbol upconversion. If the player has placed a bonus bet to buy whack-a-mole swings, there will follow a presentation in which a club is swung at the mole, whacking it down and converting it to a multiplier wild. In one embodiment, the max number of swings that can occur depends on how many the player bought (1/2/3).

In such an example, if one mole appears and the player purchased 1/2/3 swings, that mole will get whacked and converted to a multiplier wild. Any remaining swings will be unused. If 2 moles appear and the player purchased 1 swing, then only one of the two moles will get whacked and converted to a multiplier wild. The other wild will be revealed but then converted back to the original symbol. The player may get to choose which of the two mole multipliers to whack, or the selected mole may be chosen at random by the gaming device. If the player purchased 2/3 swings, then both moles will get whacked and converted to multiplier wilds. Any remaining swings will be unused. If 3 moles appear and the player purchased 1 swing, then only one of the three moles will get whacked and converted to a multiplier wild. If the player purchased 2 swings, then two moles will get whacked and converted to multiplier wilds. If the player purchased 3 swings, then all three moles will get whacked and converted to multiplier wilds. Any remaining swings will be unused. Un-whacked wilds may, in one embodiment, be revealed to the player, but then converted back to the original symbols.

In other embodiments, the whacks may not be guaranteed to hit the mole, which may help increase the feature frequency. In other embodiments, unused whacks may not be used if less moles appeared than whacks purchased. Here, the whacks may be saved for later use. Although the above description relates to a whack-a-mole embodiment, the same principles may be used in a variety of game themes.

Figure 11:
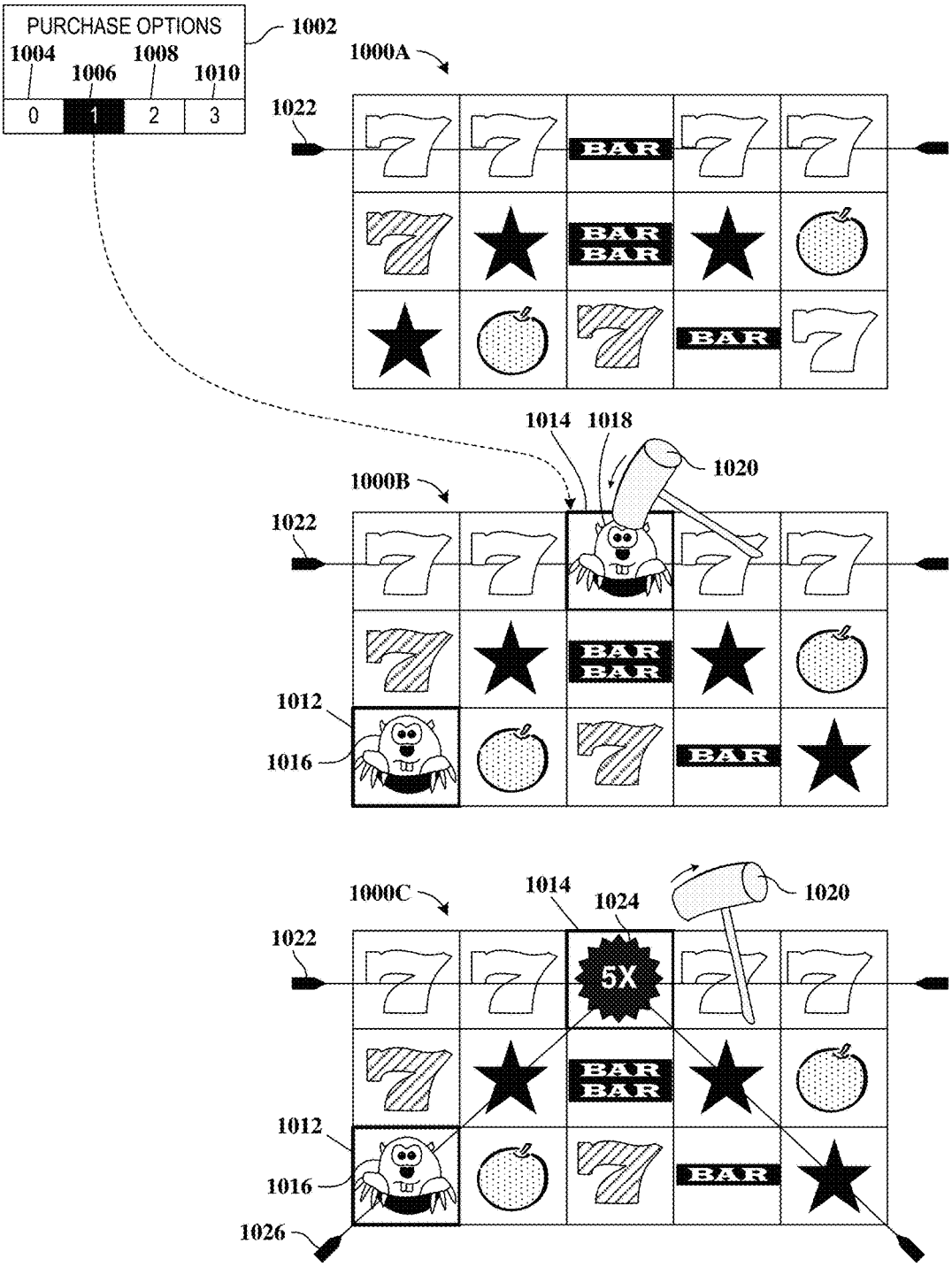
FIG. 11 illustrates a representative example of a slot game employing a symbol upgrade feature with a multi-tier purchase option and symbol conversion presentation.

FIG. 11 illustrates a representative example of a slot game employing a symbol upgrade feature with a multi-tier purchase option and symbol conversion presentation. This example employs a whack-a-mole theme similar to that described above, but again this theme is described merely for purposes of facilitating an understanding of one of a wide variety of themes that could be used to expose upgraded slot game symbols when awarded. The example is described in connection with a sequence of slot game grids 1000A, 1000B, 1000C.

In one embodiment, the player is presented with a user interface 1002 where options to purchase symbol upgrades and/or any other payout enhancement upgrade. The user interface 1002 of FIG. 11 includes a user input 1004 to purchase no symbol upgrade options, a user input 1006 to purchase one symbol upgrade option, a user input 1008 to purchase two symbol upgrade options, and a user input 1010 to purchase three symbol upgrade options. As previously noted, any number of purchase options may be utilized in a particular game, and the maximum of three in the embodiment of FIG. 11 is merely an example. In one embodiment, the purchase options include at least the opportunity to select zero, one, or two options. In this manner, if the player chooses to purchase any options, then a decision will be involved as to how many to select. Therefore, in one embodiment, there are at least a plurality of non-zero purchase options available to the player.

The example of FIG. 11 assumes, for purposes of example, that the player has selected to purchase one symbol upgrade option via user input 1006. In this embodiment, the slot game grid 1000A may be initially populated, whereby existing symbols are then converted to the upgrade symbols. For purposes of example, the embodiment of FIG. 11 assumes that to symbol upgrades were awarded. These symbol upgrades may visually replace the existing symbols at the symbol locations where the upgrades will occur. As previously mentioned, the symbol locations in which symbol upgrade awards may occur can be entirely random, may be limited to one or more reels or symbol locations, may be positioned in a predetermined pattern, or however desired. In the illustrated embodiment, it is assumed that the symbol locations in which upgrades will occur were selected randomly, and were selected to be symbol locations 1012 and 1014.

To provide a more interesting transition from original symbols to the upgraded symbols at symbol locations 1012 and 1014, the original symbols transform in some way to visually identify the symbol as a potential upgrade symbol, depending on whether the player purchased options to obtain the benefit of any of the upgraded symbols. In the illustrated embodiment, a hole opens in the original symbols, and a critter, such as a mole, appears through the hole. As shown on slot game grid 1000B, two such moles are presented, namely mole 1016 at symbol location 1012, and mole 1018 at symbol location 1014.

At this point, the player would know how many symbol upgrades were randomly awarded for this particular reel spin, since the upgrade symbols 1016 and 1018 can be seen by the player. However, the player may or may not get the benefit of both, or either symbol upgrades, unless the player purchased a number of symbol upgrade options to use one or both of the symbol upgrades. Here, the player had opted to purchase one symbol upgrade option, so the player will obtain the benefit of one of the two symbol upgrades 1016, 1018.

In one embodiment, the player can select which of the available symbol upgrades is desired. In another embodiment, a number of symbol upgrades corresponding to the number purchased by the player are randomly revealed for its underlying symbol upgrade value. FIG. 11 is one such example, where the game randomly selects one (as the player purchased only one) of the symbol upgrade symbols 1016, 1018 in which to reveal an underlying symbol upgrade value that is usable on the grid 1000B for the player. The selection may be accomplished in any desired manner. In a "whack-a-mole" embodiment, a mallet 1020 or other striking device may be animated to whack the randomly-selected mole, such as the mole upgrade symbol 1018 in this example. The moles may be struck, for example, at substantially the same time to reveal the symbol upgrade value at once, or may be struck sequentially to present the results one at a time. The order or manner of striking (or otherwise activating) the symbols to reveal the symbol upgrade value may differ where there are more symbols to activate than were purchased, such as moving the mallet 1020 back and forth between the visible upgrade symbols 1016, 1018 and ultimately whacking the one usable by the player.

The payline 1022 shown on original grid 1000A had no winning symbol combination, assuming at least three like symbols in a row provide a winning payout. Upgrade symbol 1018 shown on grid 1000B, as activated in any manner (e.g., by whacking the mole upgrade symbol 1018 with the mallet 1020), notifies the player that symbol location 1014 will result in an upconverted symbol that is available to the player. Slot grid 1000C shows the result of upgrading the symbol at symbol location 1014, which is a 5×-wild symbol 1024 in the present example. By way of this symbol upgrade, a winning payout is now available on payline 1022, as a string of five "7" symbols has occurred in view of the upconverted 5×-wild symbol 1024. Any payout on payline 1022 will then be multiplied by five in view of the 5× multiplier associated with the upconverted 5×-wild symbol 1024.

In one embodiment, and upgraded symbol may be applied for any winning payout on any payline passing through the symbol location of an upgraded symbol. In other embodiments, the upgraded symbol may be applied for one winning payout on one payline passing through the symbol location of an upgraded symbol, such as the highest payout amount, lowest payout amount, average payout amount, etc. In other embodiments, an upconverted symbol 1024 may apply to more than just what is on paylines passing through the associated symbol location, such as being applied globally to any payout, or some other subset of payouts, on the grid 1000C. In such a global embodiment, if more than one multiplier or other payout modifier is provided, they may interact before being applied to all payouts on the grid 1000C (e.g., added together, multiplied together, one serving as an exponent to the other, etc.).

In the embodiment of FIG. 11, another payline, payline 1026, passes through the symbol location 1014 of the activated symbol 1024. However, since the player elected to purchase only one symbol upgrade option, and because the system randomly selected symbol location 1014 (or the symbol at that location) for symbol upgrade, the upgrade symbol 1016 at symbol location 1012 is not converted to provide a usable symbol upgrade value for the player. Therefore, in one embodiment, the upgrade symbol 1016 (or in other embodiments the original symbol, or other symbol) remains a blocking symbol, and no paylines involving symbol location 1012 result in a winning payout.

Add the player decided to purchase either two or three symbol upgrade options, the player would have also received the benefit of the upgrade symbol 1016 at symbol location 1012 being upconverted to a symbol of value, such as another wild-multiplier symbol. For example, as shown at grid 1000C of FIG. 11, had the player elected to purchase at least one more symbol upgrade option to enable a multiplier-wild symbol to be positioned at symbol location 1012, the player would have received another payout on payline 1026 of five star symbols. Because there would have been two activated multiplier-wild symbols at symbol positions 1012 and 1024, the multipliers, in one embodiment, would have interacted to form a larger multiplier. For example, had symbol 1016 then activated and converted into a 3×-wild symbol, the resulting multiplier value may have been increased to a total of 8× (5× plus 3×), or in other embodiments a total of 15× (5× times 3×), etc. Therefore, the player lost a potentially large payout on payline 1026 by failing to purchase a number of symbol upgrade options equal to or larger than the number of symbol upgrade awards that were granted.

Figure 12A:
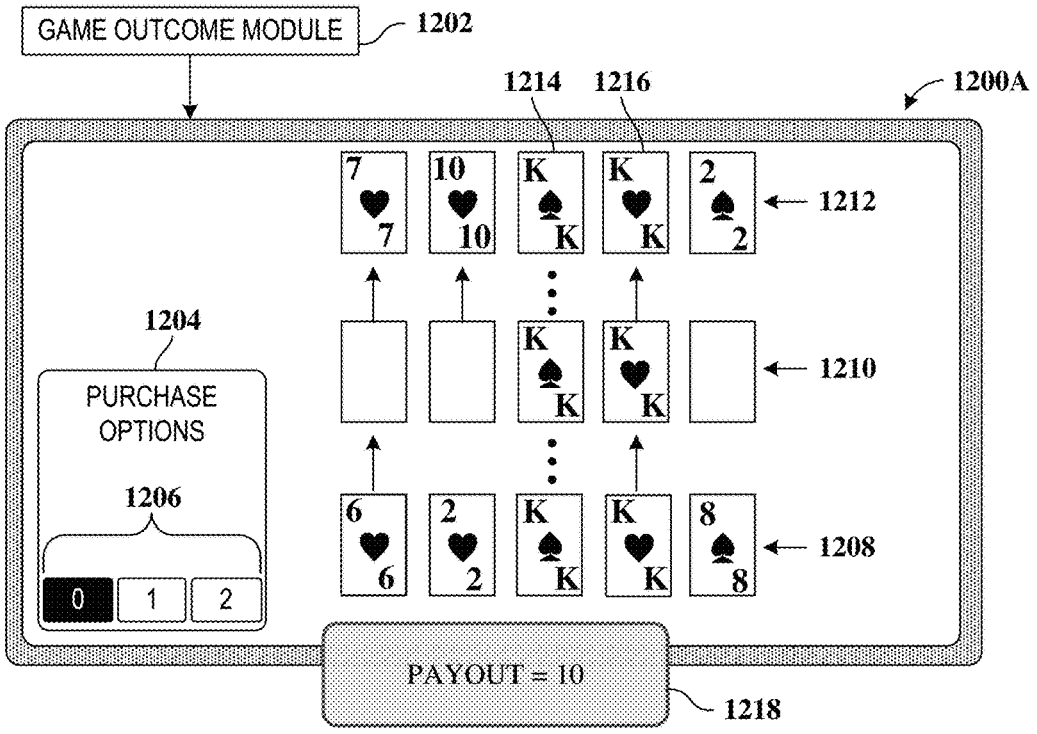
FIGS. 12A and 12B illustrate a poker game embodiment that allows player purchase of symbol upgrade options and random game selection of symbol upgrade awards.
Figure 12B:
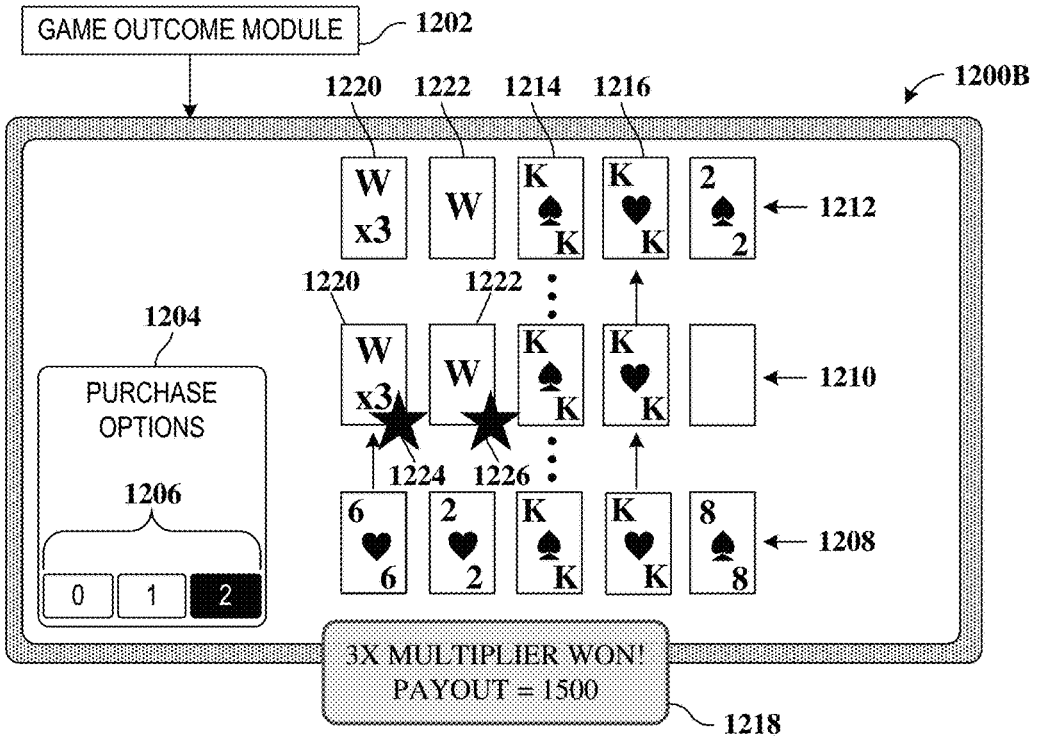

FIGS. 12A and 12B illustrate other representative embodiments of game that allow players to purchase some number of symbol upgrade options to enable use of a commensurate number of randomly granted symbol upgrade awards. FIG. 12A depicts a representative draw poker game presented on a gaming display 1200A. The game outcome module 1202 may represent the software-programmed or otherwise configured hardware to specify a given one or more game combination results, such as poker hands, stud poker hands, hold-em poker hands, or any other card game hands. The game outcome module 1202 may include the game probability configuration parameters such as the number of card decks, the number of each card in each deck, and/or other indicia on the cards. These variables provide a natural probability of occurrence of any of the game combination results associated with that card/gaming event. The game outcome module 1202 also represents the game combination generation and determination functions which generates one or more card hands, and selects the original cards/hands, any replacement cards/hands (e.g., draw cards), etc. to produce game outcomes.

A user interface 1204 is provided that enables the player to purchase zero, one or two (in this example) symbol upgrade options 1206. Symbol upgrade awards may be randomly granted as previously described, and the user is allowed to make use of any number of the granted symbol upgrade awards in which the player purchased options for; i.e. the player can use two granted symbol upgrade awards if the player purchased at least two options. For the poker hand of FIG. 12A, it is assumed that the player has purchased no symbol upgrade options.

In the example of FIG. 12A, an original hand 1208 is dealt, that by chance includes a Six of Hearts (6-H), Two of Hearts (2-H), King of Spades (K-S), King of Hearts (K-H), and Eight of Spades (8-S). As this example is a draw poker embodiment, the player is allowed to retain or "hold" one or more cards of the original hand 1208. In this example, the player holds two cards (assume the K-S and K-H) and discards the rest as depicted at intermediate hand 1210. When the discarded cards are replaced to provide a final hand 1212, the best payout available for the cards of the final hand 1212 are a pair of kings, including the K-S 1214 and the K-H 1216, which is assumed to pay ten (10) credits in this example, as may be presented via a display window 1218 or elsewhere.

FIG. 12B depicts another poker hand, where the player opted to purchase two symbol upgrade awards via the user interface 1204. For purposes of comparison, the same starting hand 1208 and intermediate hand 1210 are assumed. However, the player purchased two symbol upgrade options, and it is assumed that two symbol upgrade awards 1220, 1222 were randomly provided. The granted symbol upgrade awards 1220, 1222 are associated with the discarded cards that would otherwise be replaced in a draw poker game, although in other embodiments the granted symbol upgrades may be associated with other cards, such as to provide upgraded cards on the post-draw hand 1212. For stud poker or other poker games, it can similarly be decided at which point the symbol upgrades may be awarded.

In this example, the granted symbol upgrade awards are identified by sub-symbols, which are star symbols 1224, 1226 in this example. This embodiment assumes that the symbol upgrade cards are wild cards, which may or may not further be associated with a multiplier. Thus, the symbol upgrade cards 1220, 1222 carry to the final hand 1212, as do the held cards 1214, 1216, thereby creating an enhanced payout for four-of-a-kind in kings (i.e. two wild cards 1220, 1222 and two kings 1214, 1216), plus the 3× multiplier associated with the symbol upgrade 1220. If four kings provides a payout of 500 credits, then the total award in view of the 3× multiplier is 1500 credits, as noted at display window 1218.

As can be seen, the player's payout was significantly larger in the example of FIG. 12B relative to that of FIG. 12A, based on the game's random presentation of two symbol upgrade awards, and the player's ability to use them both based on the player's purchase of two symbol upgrade options. These principles may be applied to other poker variations, such as multi-hand poker, where cards held in an initial hand(s) are replicated in a plurality of final hands, with draw cards filling in for discarded cards. In such an embodiment, the awarded symbol upgrade cards may be used in the initial hand (and thus able to be replicated into a plurality of additional played hands), and/or may be used in the final hand to replace symbols that were either held or replaced.

The features described herein can be used in connection with any game of chance, including slot games, poker games, keno, roulette, bingo, and the like. They may be provided using physical structures, or electronic structures created in computing hardware and displayed as virtual structures of such physical structures. The gaming events described herein may be provided as a base game of chance or an auxiliary gaming event such as a bonus event, free spin event, or other secondary event.

Figure 13A:
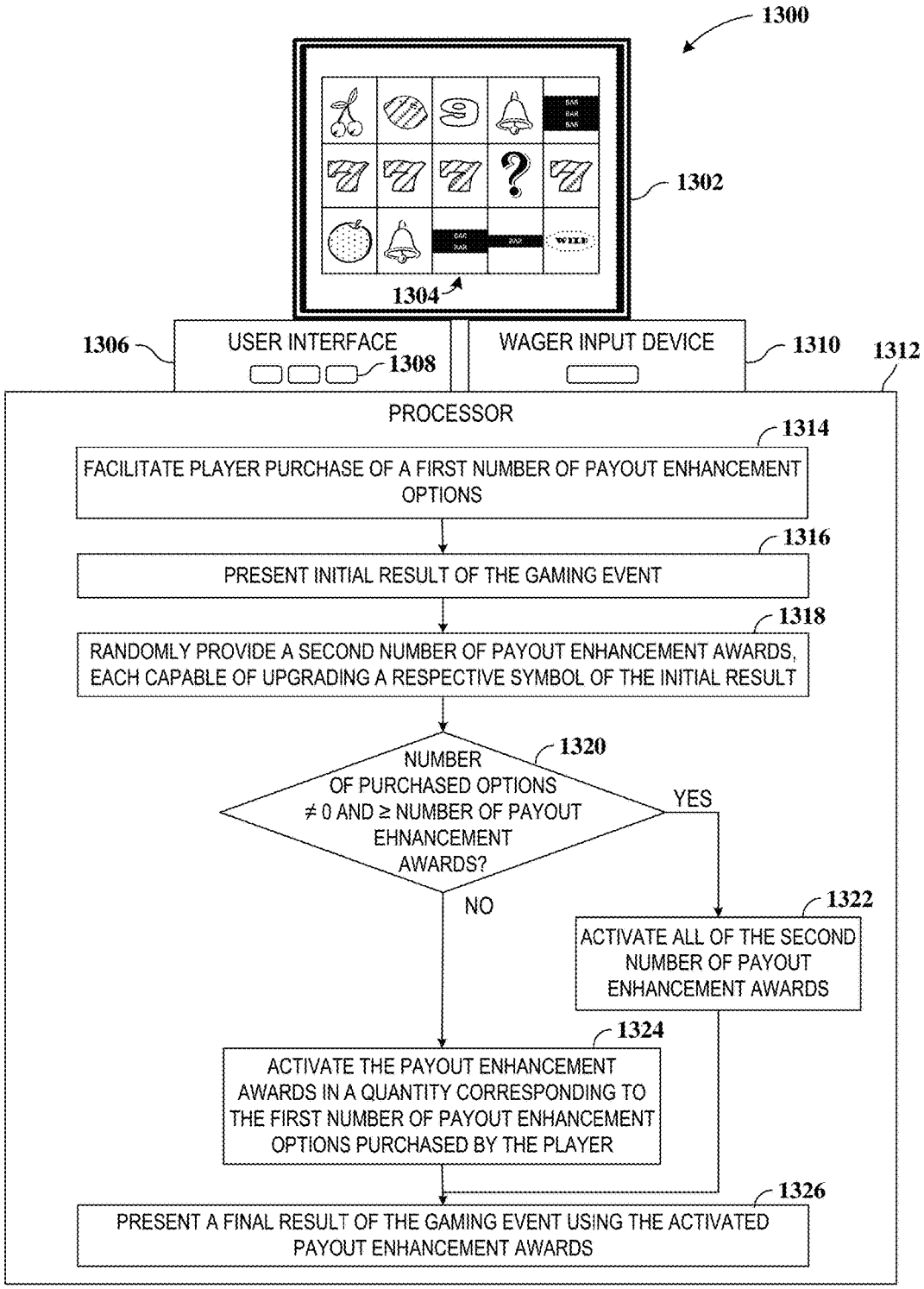
FIGS. 13A and 13B are block diagrams of representative alternative slot game apparatuses for enhancing payout modifiers in accordance with the disclosure.

FIG. 13A is a block diagram of a representative slot game apparatus for enhancing payout modifiers according to player option purchases. In this embodiment, a slot game device 1300 is provided on which players can play slot games. The representative slot game device 1300 includes at least a display 1302 presenting a slot game symbol array or "grid" 1304 of symbol locations, a user interface 1306 including at least one user input 1308 to enable a player to initiate a slot game event presented via the slot game grid 1304, and a wager input device 1310 structured to identify and validate player assets and ultimately permit the player to play the slot game event when the player assets are provided. The slot game device 1300 also includes a processor 1312 configured to facilitate 1314 purchase by a player of a first number of payout enhancement options, present 1316 an initial result of a gaming event, and randomly provide 1318 a second number of payout enhancement awards, each capable of upgrading a respective symbol of the initial result of the gaming event. If it is determined 1320 that the first number of payout enhancement options purchased by the player is not zero and is greater than or equal to the second number of randomly provided payout enhancement awards, then all of the second number of payout enhancement awards are activated 1322. Otherwise, the first number of payout enhancement options purchased by the player is less than the second number of randomly provided payout enhancement awards, in which case the first number of the payout enhancement awards is activated 1324. A final result of the gaming event is presented 1326 using the activated payout enhancement awards.

The slot game device 1300 configures the processor 1312 (which may include one or more cooperative processing devices) to structurally program functional elements into hardware modules. Processor 1312 circuitry configuration thus changes based on the modules developed by software to carry out the desired methodology. For example, the processor 1312 is programmed by software/code to create a hardware-based module to facilitate 1314 player purchase of payout enhancement options, and to create other such software/code modules for each of the operations 1314-1326.

Figure 13B:
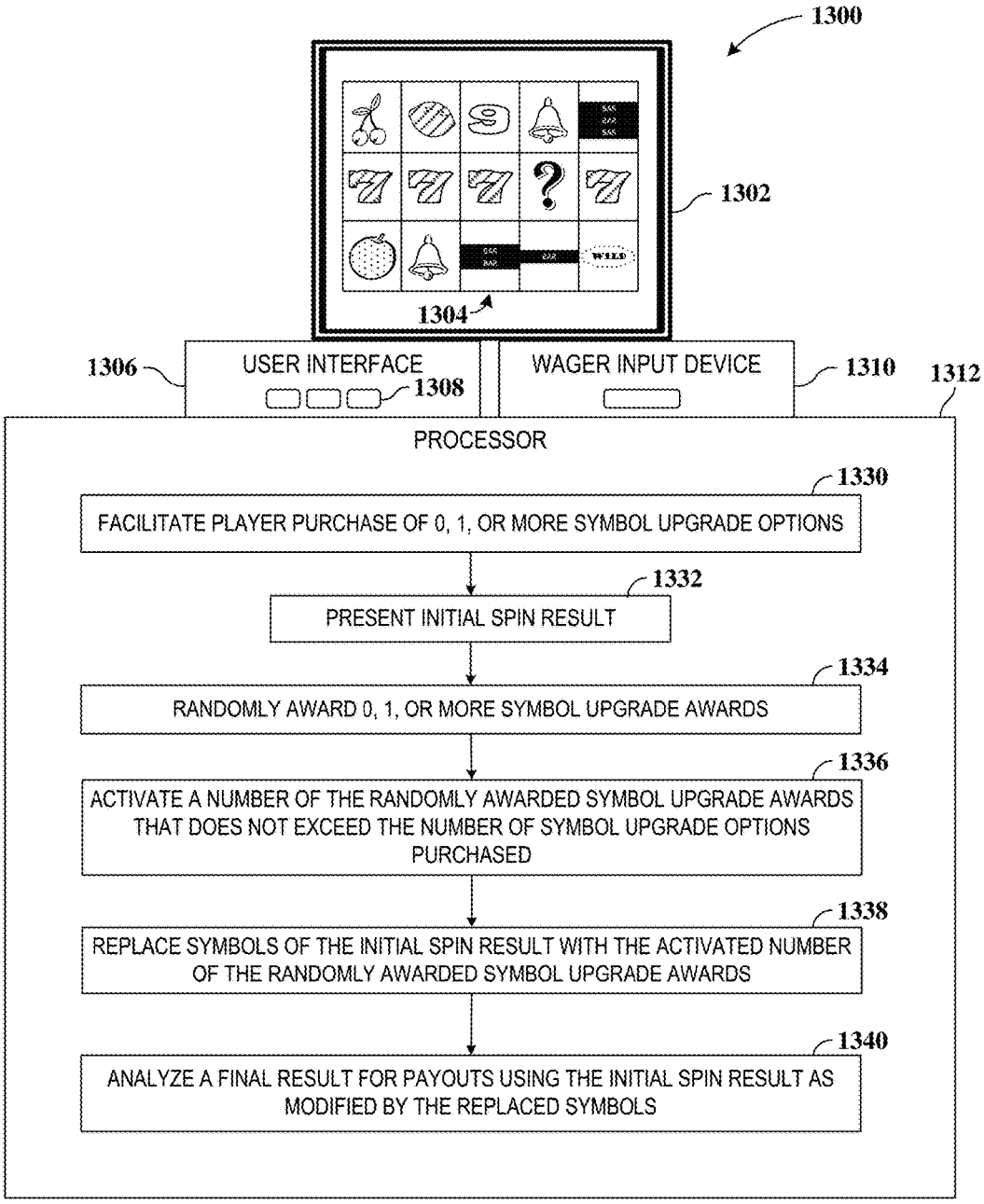

Other structural modules may be created on the slot game device using a properly configured processor 1312. Referring now to the example of FIG. 13B, the processor 1312 may be configured into programmed modules to facilitate player purchase of zero, one, or a plurality of symbol upgrade options, present an initial spin result, randomly award zero, one, or a plurality of symbol upgrade awards, activate a number of the randomly awarded symbol upgrade awards that does not exceed the number of symbol upgrade options purchased, replace symbols of the initial spin result with the activated number of the randomly awarded symbol upgrade awards, and analyze a final result for payouts using the initial spin result as modified by the replaced symbols.

The foregoing description of the representative embodiments has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of gaming activities that are capable of being played in a table version (e.g., machines involving poker or card games that could be played via table games).

Some embodiments have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out above.

What is claimed is:

1. A slot game apparatus for enhancing gaming awards in a slot game utilizing symbols in respective symbol positions of a symbol grid to determine payouts, comprising:

a display presenting a plurality of symbol locations forming a symbol array;

a user interface including at least one user input to enable a player to initiate a slot game event presented via the symbol array;

a wager input device structured to identify and validate player assets, and to permit the player to play the slot game event when the player assets are provided; and a processor configured to:

facilitate player purchase of zero, one, or a plurality of symbol upgrade options;

present an initial spin result;

randomly award zero, one, or a plurality of symbol upgrade awards;

activate a number of the randomly awarded symbol upgrade awards that does not exceed the number of symbol upgrade options purchased;

replace symbols of the initial spin result with the activated number of the randomly awarded symbol upgrade awards; and analyze a final result for payouts using the initial spin result as modified by the replaced symbols.

2. The slot game apparatus of claim 1, wherein the processor being configured to randomly awarding zero, one, or a plurality of symbol upgrade awards comprises the processor being configured to randomly award at least one of the symbol upgrade awards, and randomly positioning the randomly awarded the at least one of the symbol upgrade awards in respective ones of the symbol positions to replace the symbols therein with the respective symbol upgrade awards.

3. The slot game apparatus of claim 1, wherein the processor is further configured to recognize player purchase of zero of the symbol upgrade options, and wherein the processor is configured to activate a number of the randomly awarded symbol upgrade awards that does not exceed the number of symbol upgrade options purchased by activating zero of the randomly awarded symbol upgrade awards.

4. The slot game apparatus of claim 1, wherein the processor is further configured to recognize player purchase of a number of the symbol upgrade options, and wherein the processor is configured to activate a number of the randomly awarded symbol upgrade awards that does not exceed the number of symbol upgrade options purchased by activating fewer of the randomly awarded symbol upgrade awards than were randomly awarded in response to the player's purchase of fewer of the symbol upgrade options than the number of the symbol upgrade awards that were randomly awarded.

5. The slot game apparatus of claim 1, wherein the processor is further configured to recognize player purchase of a number of the symbol upgrade options, and wherein the processor is configured to activate a number of the randomly awarded symbol upgrade awards that does not exceed the number of symbol upgrade options purchased by activating fewer of the randomly awarded symbol upgrade awards than the number of symbol upgrade options that were purchased, in response to a the player's purchase of more of the symbol upgrade options than the number of the symbol upgrade awards that were randomly awarded.

6. The slot game apparatus of claim 1, wherein the processor is configured to replace symbols of the initial spin result by replacing the symbols of the initial spin result with symbols having a higher game value than the symbols of the initial spin result.

7. The slot game apparatus of claim 6, wherein the processor is configured to replace the symbols of the initial spin result by replacing the symbols of the initial spin result with wild symbols.

8. The slot game apparatus of claim 7, wherein the processor is configured to replace the symbols of the initial spin result with wild symbols further by associating a payout multiplier value with each of the wild symbols.

9. The slot game apparatus of claim 1, the processor is further configured to provide a visual transition from the symbol upgrade awards to activated ones of the symbol upgrade awards.

10. A game apparatus for enhancing gaming awards in a slot game utilizing symbols in respective symbol positions of a symbol grid to determine payouts, comprising:

a display presenting a plurality of symbol locations forming a symbol array;

a user interface including at least one user input to enable a player to initiate slot game events presented via the symbol array;

a wager input device structured to identify and validate player assets, and to permit the player to play the slot game event when the player assets are provided; and a processor configured to:

facilitate purchase by a player of a first number of payout enhancement options;

present an initial result of a gaming event;

randomly provide a second number of payout enhancement awards, each capable of upgrading a respective symbol of the initial result of the gaming event;

if the first number of payout enhancement options purchased by the player is not zero and is greater than or equal to the second number of randomly provided payout enhancement awards, activate all of the second number of payout enhancement awards;

if the first number of payout enhancement options purchased by the player is less than the second number of randomly provided payout enhancement awards, activate the first number of the payout enhancement awards, and present a final result of the gaming event using the activated payout enhancement awards.

11. The game apparatus of claim 10, wherein the first number of payout enhancement options purchased by the player is zero, and wherein none of the second number of provided payout enhancement awards are activated.

12. The game apparatus of claim 10, wherein the processor is configured to activate the first number of the payout enhancement awards by randomly selecting symbols of the gaming event to upgrade to upgraded symbols, and activating the first number of the payout enhancement awards to replace the randomly selected symbols.

13. The game apparatus of claim 10, wherein the processor is configured to activate the first number of the payout enhancement awards by randomly selecting symbol locations of the gaming event to upgrade their respective initial symbols to upgraded symbols, and activating the first number of the payout enhancement awards to replace the initial symbols at the randomly selected symbol locations.

14. The game apparatus of claim 10, wherein the processor is configured to randomly provide the second number of payout enhancement awards further by revealing to the player the payout enhancement awards that were not activated as a result of the player failing to purchase enough of the payout enhancement options to activate the payout enhancement awards that were not activated.

15. The game apparatus of claim 10, wherein the first number of payout enhancement opportunities is between zero and three.

16. The game apparatus of claim 15, wherein the second number of payout enhancement awards is between zero and three.

17. A slot game apparatus for enhancing gaming awards in a slot game utilizing symbols in respective symbol positions of a symbol grid to determine payouts, comprising:

means for facilitating player purchase of zero, one, or a plurality of symbol upgrade options;

means for presenting an initial spin result;

means for randomly awarding zero, one, or a plurality of symbol upgrade awards;

means for activating a number of the randomly awarded symbol upgrade awards that does not exceed the number of symbol upgrade options purchased;

means for replacing symbols of the initial spin result with the activated number of the randomly awarded symbol upgrade awards; and means for analyzing a final result for payouts using the initial spin result as modified by the replaced symbols.

* * * * *